US005894294A

United States Patent [19]

Morita

[11] Patent Number: 5,894,294

[45] Date of Patent: Apr. 13, 1999

[54] SEWING PATTERN DISPLAY DEVICE

[75] Inventor: Nami Morita, Nagoya, Japan

[73] Assignee: Brother Kogyo Kabushiki Kaisha, Nagoya, Japan, JPX

[21] Appl. No.: 08/800,391

[22] Filed: Feb. 14, 1997

[30] Foreign Application Priority Data

| | | | |
|---|---|---|---|
| Feb. 22, 1996 | [JP] | Japan | 8-035077 |
| Feb. 29, 1996 | [JP] | Japan | 8-042680 |
| Jan. 28, 1997 | [JP] | Japan | 9-014253 |

[51] Int. Cl.[6] ..... G09G 5/08

[52] U.S. Cl. ..... 345/157; 345/115; 364/188; 364/470.07

[58] Field of Search ..... 345/156, 157, 345/173, 179, 133, 115; 178/18, 19, 18.1, 18.01; 364/470.07, 470.09, 470.14, 188, 189, 190, 400; 112/445, 444, 447, 448

[56] References Cited

U.S. PATENT DOCUMENTS

| | | | |
|---|---|---|---|
| 4,698,625 | 10/1987 | McCaskill et al. | 345/145 |
| 5,319,565 | 6/1994 | Hausammann et al. | 364/470 |
| 5,379,226 | 1/1995 | Shigeta | 364/470 |
| 5,427,044 | 6/1995 | Hirabayashi | 112/266.1 |
| 5,474,000 | 12/1995 | Mizuno et al. | 364/470.09 |

FOREIGN PATENT DOCUMENTS

| | | |
|---|---|---|
| 2-1516 | 1/1990 | Japan . |

*Primary Examiner*—Xiao Wu
*Attorney, Agent, or Firm*—Oliff & Berridge, PLC

[57] ABSTRACT

A layout region, corresponding to an embroiderable region of an embroidery frame, displays selected patterns in a manner matching the patterns as they will appear when embroidered on a workpiece cloth. That is, the size and inter-distance of patterns correspond to relative dimensions and distances of the patterns with respect to the embroiderable region. The pattern presently being subjected to editing processes is displayed in the layout region in a display form different from the display form of the other patterns. A confirmation display region displays text describing the size, the central position, and the like of a pattern being subjected of editing processes. The confirmation display region also displays different colored regions of picture patterns. Data corresponding to the displayed text is stored in an internal RAM of the sewing machine.

25 Claims, 20 Drawing Sheets

SEWING PATTERN DISPLAY DEVICE

BACKGROUND OF THE INVENTION

1. Field of the Invention

The present invention relates to a device for displaying sewing patterns, such as characters and pictures, to be sewn in a workpiece cloth.

2. Description of the Related Art

There has been known a household sewing machine capable of sewing embroidery in a predetermined pattern, such as, characters and pictures, in a workpiece cloth. The sewing machine sews the embroidery based on embroidery data corresponding to a plurality of types of patterns. The household sewing machine receives the embroidery data either from an external memory medium, such as a memory card, or from an internal memory in which the embroidery data is prestored. For example, personal computers can retrieve predetermined embroidery data and control a sewing needle drive mechanism and a cloth feed mechanism, such as an embroidery frame, to sew embroidery stitches into the workpiece cloth.

Such household sewing machines can be provided with a display, such as a liquid crystal display (LCD), provided to the front surface of the main body of the sewing machine. When a user wants to start sewing operations to embroider a desired pattern, he or she can select a desired pattern from a plurality of patterns displayed on the display. A position edit mode is provided to allow combining a plurality of patterns, such as text character patterns with other character patterns or character patterns with picture patterns. In this case, after the user selects a first pattern, he or she can switch to the position edit mode, whereupon the display switches to a screen the user can use to change the positions of the selected sewing patterns. It should be noted that color display devices are expensive, so normally an inexpensive monochrome LCD is used as the display device.

FIG. 1 shows an example of the position edit screen described above. The display device 1 displays on its screen an overall layout region a representing the size of the embroidery frame the sewing machine uses to sew in the workpiece cloth. The display device 1 displays the overall layout region a displayed encompassed by a frame and superimposed with three sewing patterns g, h, and i selected by the user. The sewing patterns g, h, and i are proportionally sized images representing how the patterns will appear when embroidered on the workpiece cloth. In the example shown in FIG. 1, the sewing pattern g is a picture pattern "elephant", the sewing pattern h is a character group pattern "HAPPY", and the pattern i is a character group pattern "HIMAWARI GUMI," which is Japanese for "sunflower group". The three sewing patterns will be referred as portion patterns and the combination of the three portion patterns as an overall sewing pattern hereinafter.

The sewing machine is designed so that the user can view the screen of the display device 1 and operate an operation panel to indicate positions of the portion patterns g, h, and i, and, with respect to the character pattern groups h and i, to indicate spacing between characters, and the size of the characters, that is, to magnify or reduce the size of the characters. The display of the portion patterns g, h, and i can be moved, magnified, or reduced in accordance with these commands from the user. Once the arrangement of portion patterns is to the liking of the user, the arrangement of the overall sewing pattern is inputted so that embroidery on the workpiece cloth can be performed.

Japanese Laid-Open Patent Application No. HEI-2-1516 describes an embroidery pattern forming apparatus including a pattern memory storing data on a plurality of patterns; a pattern selection device for selecting desired patterns from the patterns; a group defining means for designating the desired patterns into groups and setting an origin coordinate for each group; a format setting means for setting format, such as orientation, font, size, and the like to the group; a display control means for displaying the groups set by the group defining means, based on the origin coordinate and with shape and positional relationship set by the format setting means; and a stitch preparation means for preparing stitch data based on the form and positional relationship of the groups as displayed on the display.

SUMMARY OF THE INVENTION

However, with the above-described conventional devices, when the user wants to move a portion pattern of the overall sewing pattern, the user must operate the operation panel to see which portion pattern is presently the subject of editing operations. In other words, it is impossible for the user to know which portion pattern of the overall sewing pattern will be moved before he or she operates the operation panel. The user can easily erroneously move a mistaken portion pattern. The same is true for the other editing functions. The user must remember which portion pattern of the overall sewing pattern is the subject of editing processes or else may edit portion patterns unnecessarily.

The composition of the overall sewing pattern is displayed during the mode for moving patterns. However, the overall image provides the user with insufficient information about the individual portion patterns. For example, because the user makes subjective judgments about details of pattern presently being moved by viewing the display of the overall image, it is difficult for the user to grasp the balance of the overall sewing pattern. The user must therefore take notes on individual patterns to remember detailed information of each pattern, for example the number of colors, the region containing each color, the central position of each pattern, and the size of the patterns.

It is an objective of the present invention to overcome the above-described problems and to provide a sewing pattern display device capable of reliably editing sewing patterns formed from a plurality of portion patterns.

In order to achieve the above-described problems, a sewing pattern display device according to the present invention includes: an overall display means for displaying an overall sewing pattern including a plurality of portion patterns; an indication means for indicating at least one portion pattern from the plurality of portion patterns; and a control means for controlling the overall display means to display the at least one portion pattern indicated by the indication means in a first display form and any remaining portion patterns not indicated by the indication means in a second display form different from the first display form.

With the above-described configuration, an overall display means displays the overall sewing pattern formed from a plurality of the pattern portions. An indication means indicates at least one portion pattern from the plurality of portion patterns. A control means controls the overall display means to display the portion pattern indicated by the indication means in a display form that differs from that of the other portion patterns. For this reason, the indicated portion is clear to the user.

According to another aspect of the present invention, the sewing pattern display device further includes a portion information display means for displaying sewing information relating to the portion pattern indicated by the indication means. With this configuration, the portion information display means displays information different from that displayed by the overall display means.

According to another aspect of the present invention, the sewing pattern display device is provided in a sewing device. The overall display unit displays an overall sewing pattern, which is formed from a plurality of portion patterns, in a manner corresponding to the sewing condition of the sewing means. An example of a sewing condition would be the sewing pattern presently being sewn. The indication means indicates at least one portion pattern from the plurality of portion patterns. The control means controls the overall display means to display the portion pattern indicated by the indication means in a display form different from that used to display the other portion patterns. In this way, the indicated portion pattern can be easily determined by the user.

According to another aspect of the present invention, the overall display means displays the overall sewing pattern in a binary display, such as a black and white dot matrix. The portion information display means separately displays different colored regions, that is, by color, of the portion pattern indicated by the indication means. The arrangement of different colored regions of the overall sewing pattern is easier to understand than when viewing the overall display means.

According to another aspect of the present invention, the sewing pattern display device is provided with a portion information display means for displaying, in a view enlarged from that displayed by the overall display means, the portion pattern indicated by the indication means. With this configuration, the portion information display means displays the indicated portion pattern in an enlarged display and so displays the sewing pattern in more detail than the overall display means. The portion information display means could also display the portion indicated by the indication means in a fixed size.

According to a further aspect of the present invention, the overall display means displays an overall sewing pattern formed from a plurality of portion patterns, which are sewn in a plurality of separate sewing operations. The indication means can indicate at least one portion pattern of the plurality of portion patterns. The control means controls the overall display means to display the portion pattern indicated by the indication means, in a display form different from a display form used for the other portion patterns. Therefore, the information on portion patterns sewn in separate operations can be more easily understood than by merely viewing the overall display means.

According to still another aspect of the present invention, the overall display means displays an overall sewing pattern formed from a plurality of portion patterns, each including subportion patterns sewn in a plurality of separate sewing operations. The indication means can separately indicate subportion patterns. The control means controls the overall display means to display the subportion pattern indicated by the indication means in a display form that differs from the display form of the rest of the subportion patterns. Therefore, information on the portion patterns sewn in different operations are easier to determine than when viewing the overall display means.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
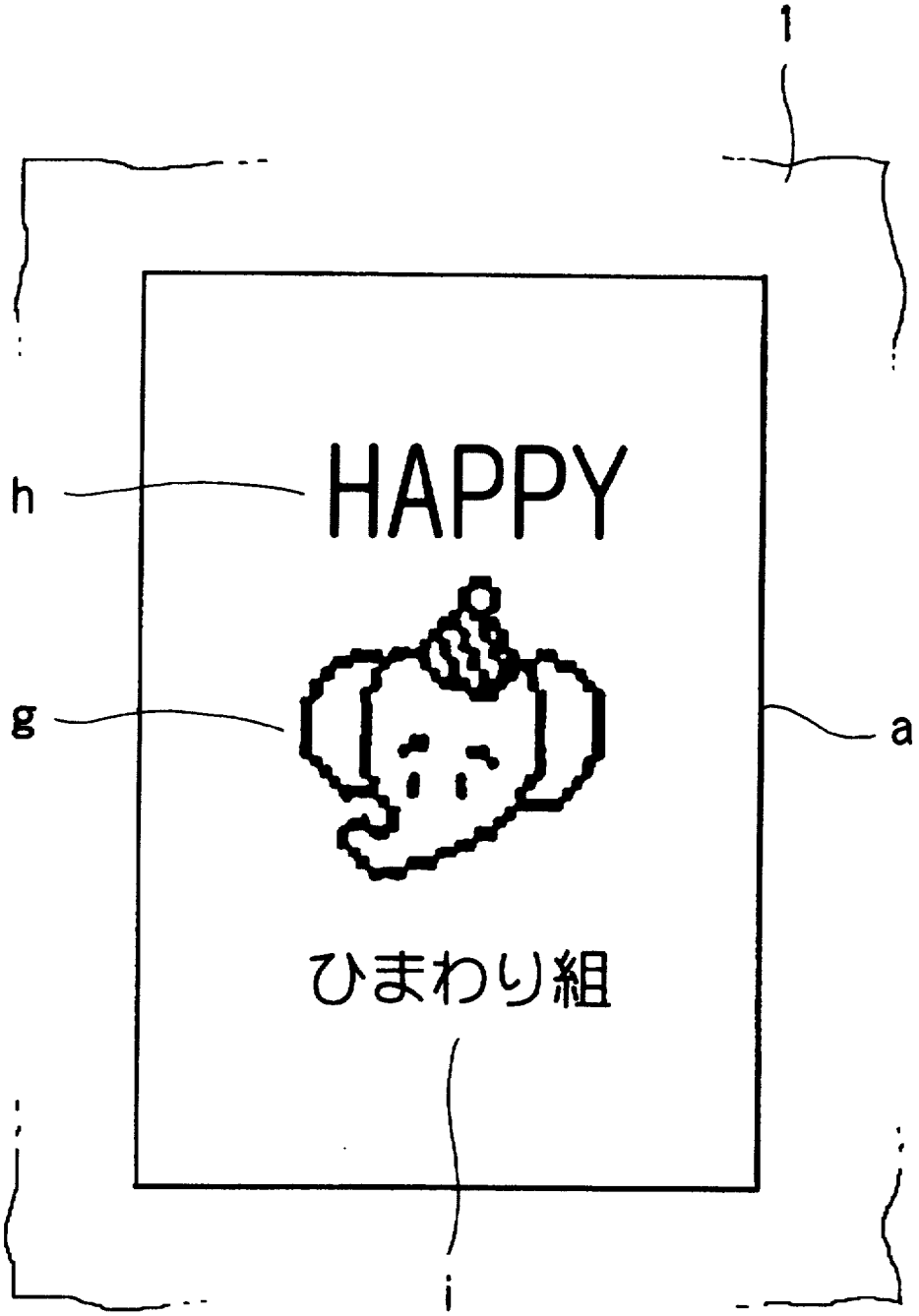
FIG. 1 is a schematic view showing a conventional sewing pattern display device.

A sewing pattern display device according to a preferred embodiment of the present invention will be described while referring to the accompanying drawings wherein like parts and components are designated by the same reference numerals to avoid duplicating description. The embodiment describes the present invention applied to a household embroidery sewing machine 11.

Figure 2:
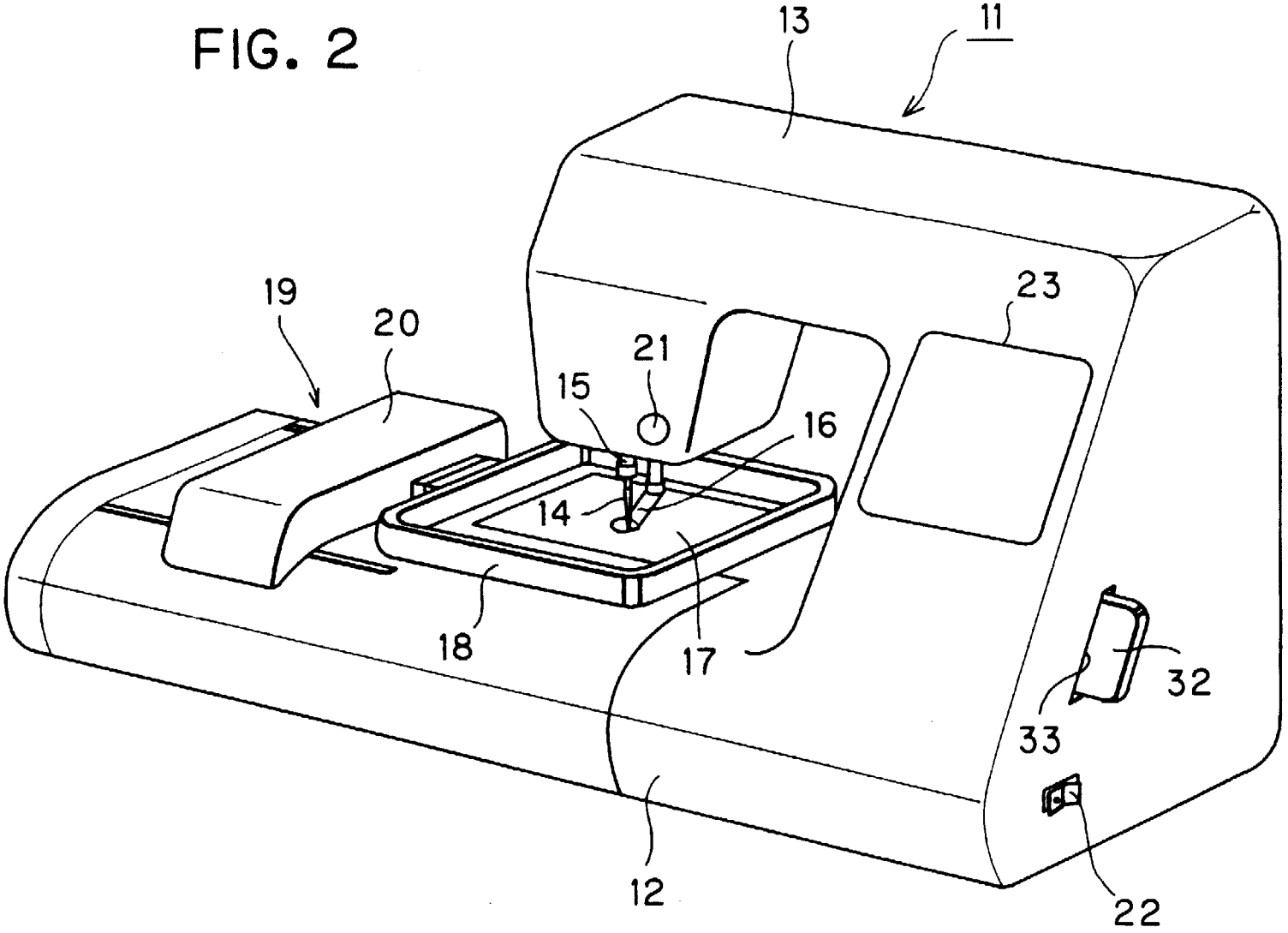
FIG. 2 is a perspective view showing a sewing machine according to an embodiment of the present invention.

FIG. 2 is a perspective view schematically showing the embroidery sewing machine 11. The sewing machine 11 includes a sewing machine bed 12 and an arm portion 13 formed integrally with the sewing machine bed 12. A sewing needle bar 15, having a needle 14, and a presser foot 16 are provided to the tip of the arm portion 13. A needle plate 17 is provided to the upper surface of the sewing machine bed 12 at a position corresponding to the needle bar 15. A shuttle mechanism (not shown in the drawings) is provided at a position under the needle plate 17. Although not shown in the drawings, a drive mechanism and a sewing machine motor are provided for driving the needle bar 15 and the shuttle mechanism in synchronization with the pressing feet 16 in order to execute sewing operations.

An embroidery frame 18 and a horizontal movement mechanism 19 are provided to the sewing machine bed 12. The embroidery frame 18 is for supporting a workpiece cloth during embroidery sewing operations. The embroidery frame 18 has a substantially rectangular shape and includes an outer frame and an inner frame between which the workpiece cloth is sandwiched. With this configuration, the workpiece cloth can be supported stretched tightly across the interior of the frame 18. The horizontal movement mechanism 19 is for moving the embroidery frame 18, and consequently the workpiece cloth, freely in the horizontal direction over the sewing machine bed 12.

Next, an embroidery sewing operation will be briefly described. A movement body 20 is configured to move the embroidery frame 18 freely in a Y-axis direction, that is, frontward and rearwards as viewed in FIG. 2, using a Y-axis motor (not shown in the drawings). The horizontal movement mechanism 19 moves the movement body 20 freely in an X-axis direction, that is, leftwards and rightwards as viewed in FIG. 2, by an X-axis motor (not shown in the drawings). The horizontal frame 19 moves the workpiece cloth supported by the embroidery frame 18 to an optional position based on an X-Y coordinate system of the horizontal movement mechanism 19. Embroidery sewing is performed by driving the needle bar 15 using the above-described drive mechanism while moving the workpiece cloth by using the horizontal movement mechanism 19.

A start/stop key 21 is provided to the front surface at the tip of the arm portion 13. A power switch 22 is provided to the lower right side surface of the sewing machine 11. The sewing machine 12 of the present embodiment is capable of performing a variety of practical sewing operations, such as, straight-line sewing, zigzag sewing, and overcasting. The horizontal movement mechanism 19 is detachably mounted on the sewing machine bed 12 so that when embroidery is not being sewn, the horizontal movement mechanism 19 can be removed from the sewing machine bed 12 with the embroidery frame 18 and replaced with a flat table for normal sewing.

Figure 7:
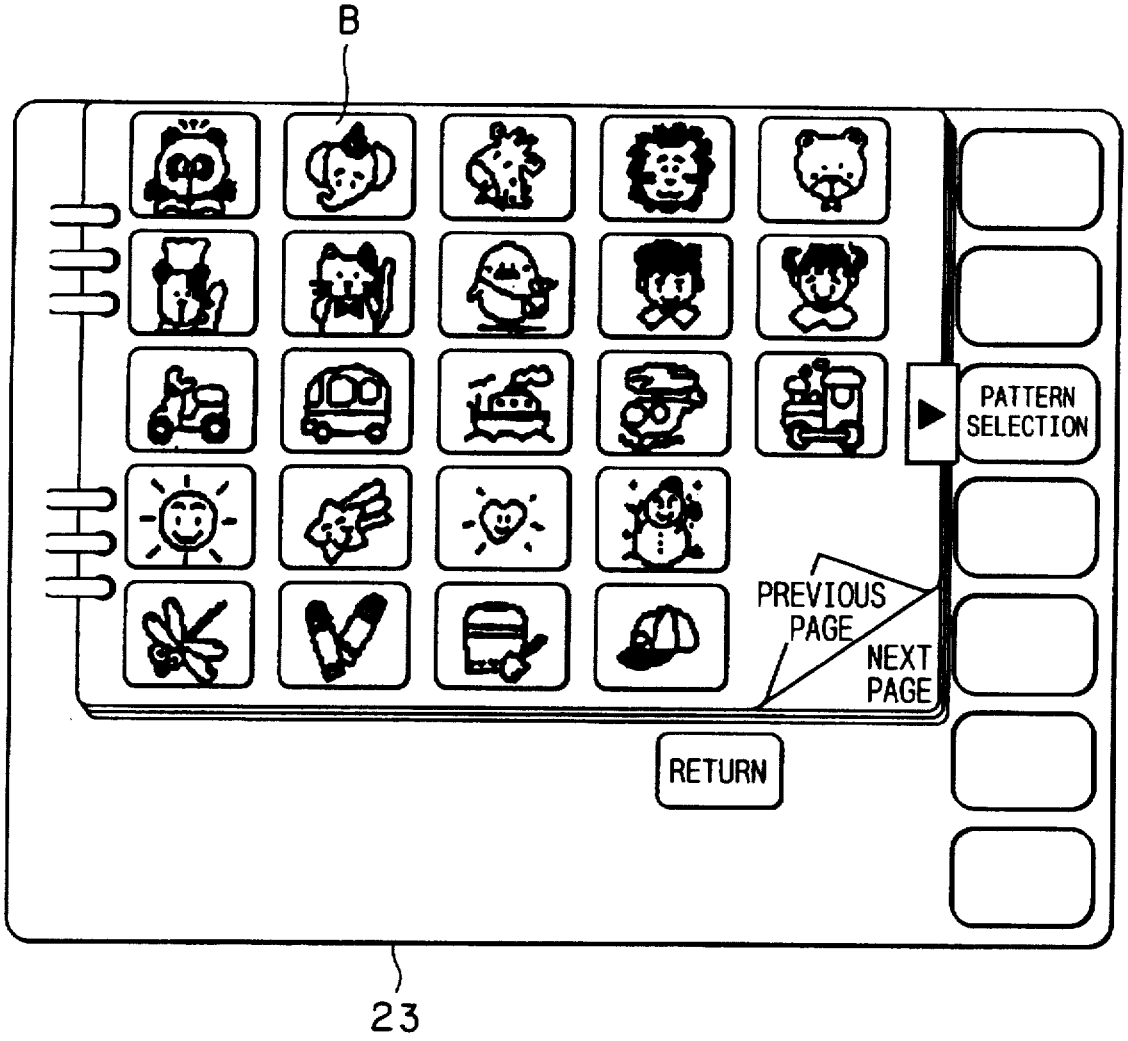
FIG. 7 is a schematic view showing a picture pattern selection screen of the sewing machine when an elephant picture pattern is selected.
Figure 8:
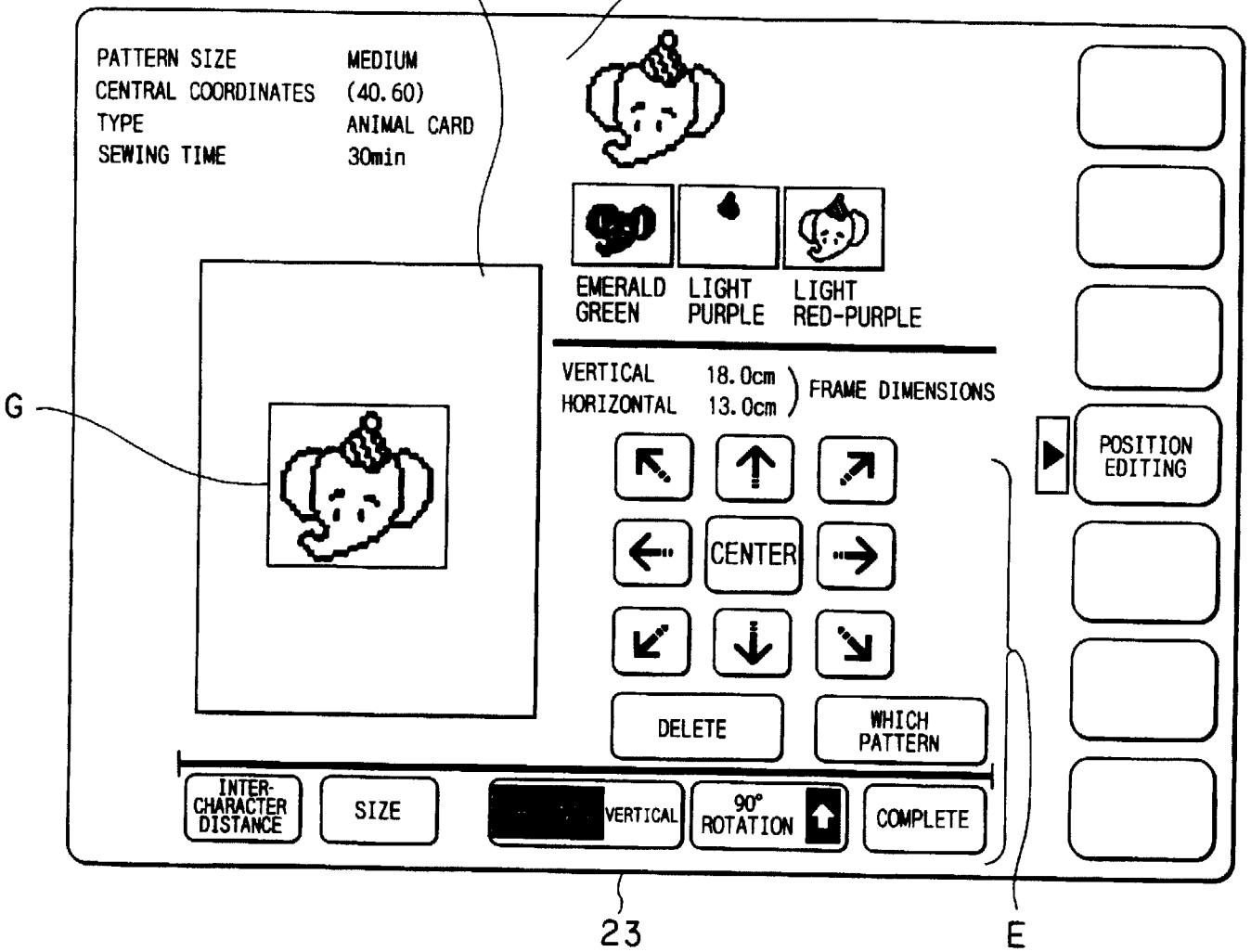
FIG. 8 is a schematic view showing a position editing screen of the sewing machine when the elephant picture pattern is the subject of editing processes.

A monotone, that is binary, liquid crystal display (LCD) 23 for displaying a variety of patterns and messages is provided to the front surface of the arm portion 13. As will be described later, the LCD 23 is used to display pattern selection screens shown in FIGS. 5 and 7, for example, and, as shown in FIG. 8 a pattern position editing screen the user uses to execute embroidery operations. Further, a touch panel 24 (see FIG. 3) is provided on the surface of the LCD 23. The touch panel 24 is a well-known unit a user can use to select different operations. The touch panel 24 is configured from transparent electrodes aligned vertically. The touch panel 24 detects where a user touches it and displays content according to the user's selection.

Figure 3:
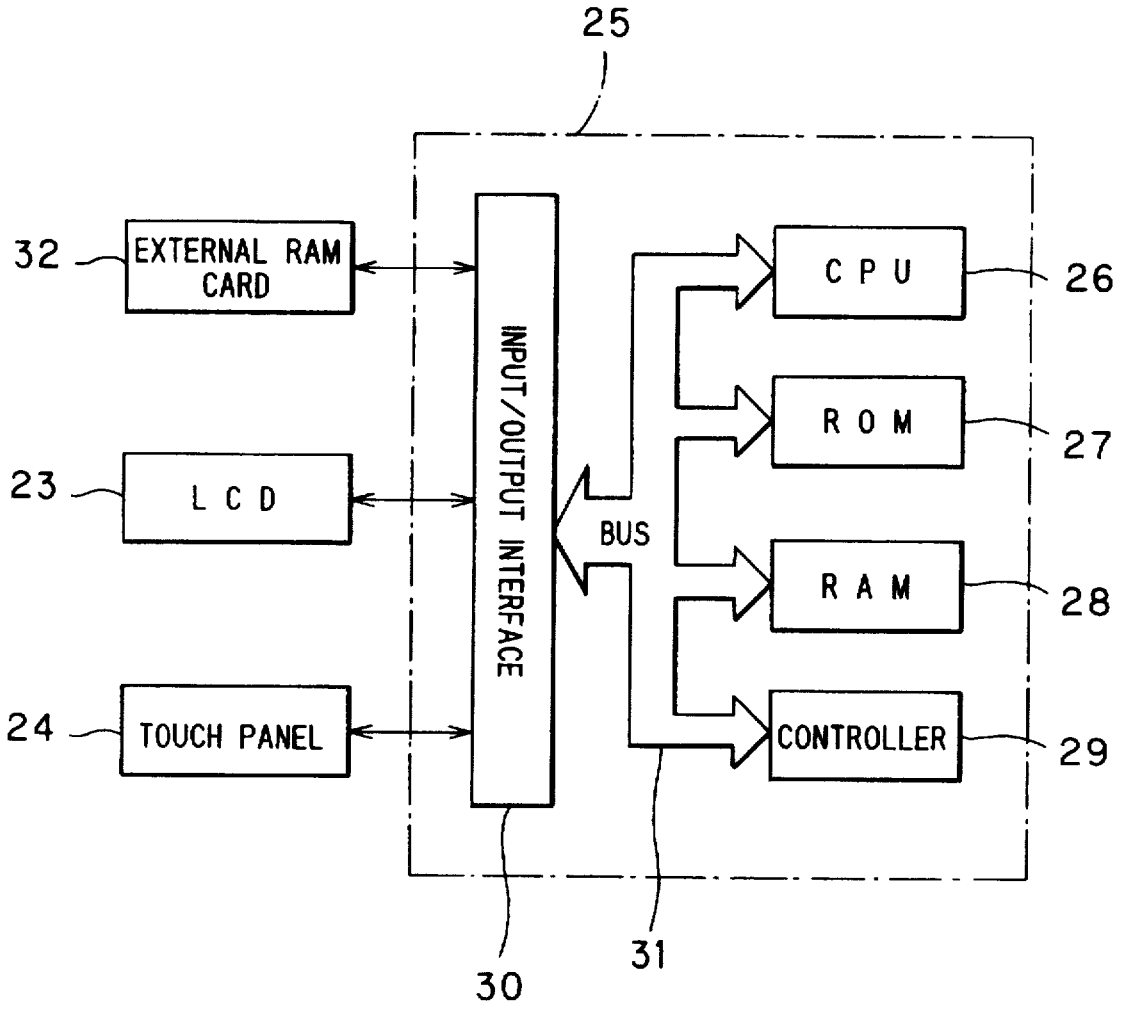
FIG. 3 is a block diagram showing electrical configuration of control components of the sewing machine.

As shown in FIG. 3, a control device 25, such as a microcomputer, for controlling the various mechanisms described above is provided in the sewing machine 11. The control device 25 includes a CPU 26, a ROM 27, a RAM 28, a controller 29, and an input/output interface 30, all connected by a bus 31. Via the controller 29, the control device 25 controls components such as the sewing machine motor and the X-axis and Y-axis motors of the horizontal movement mechanism 19. The LCD 23 and the touch panel 24 are also connected to the input/output interface 30.

The ROM 27 stores control programs for controlling practical sewing operations and embroidery sewing operations of the sewing machine 11; a control program for controlling display of the LCD 23; and a data processing program for performing editing and other data processes on retrieved embroidery data. As will be described later, the control device 25 executes the control program for controlling display of the LCD 23 in order to control a variety of displays.

Figure 5:
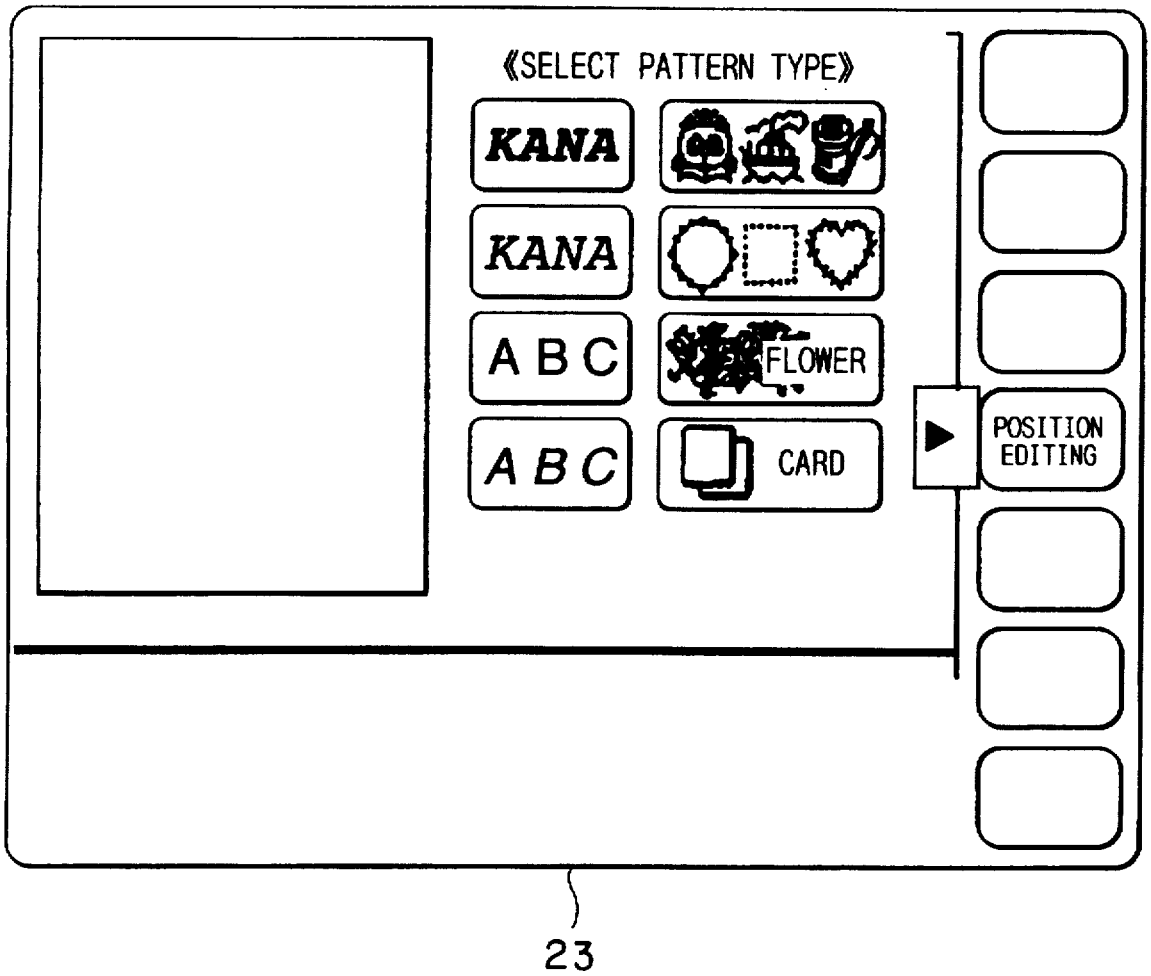
FIG. 5 is a schematic view showing a pattern type selection screen of the sewing machine.

The ROM 27 stores pattern data for accurately sewing a plurality of individual embroidery patterns. The ROM 27 stores pattern data for ornamental patterns formed by relatively simple shapes and patterns, for symbols and characters, such as, alphanumeric characters and Japanese kana, a portion of which are shown in FIG. 5.

In the present embodiment, the pattern data includes embroidery data required for embroidery sewing; display data formed from bit map data required to display each pattern on the LCD 23; and appended data, such as thread color data appended to the embroidery data and to the display data. The embroidery data is stored in the form of contour data for indicating an external outline, that is, contour, of each pattern. When embroidery sewing is to be performed, calculations are performed on the contour data to develop it into embroidery data indicating each stitch position, that is, movement amounts across the workpiece cloth in the X and Y directions for each stitch. Alternatively, the same data can be used for both embroidery data and display data. In other words, only one set of data needs to be stored and the other set of data can be developed from the stored set.

In the present embodiment, an external card ROM 32, serving as a memory means, is detachably connected to the control device 25. The external card ROM 32 stores pattern data, such as embroidery data, display data, and appended color related data, corresponding to relatively complicated picture patterns. Accordingly, both the ROM 27 and external card ROM 32 serve as memory medium in the present embodiment. To connect the external card ROM 32 to the control device 25, a user freely detachably inserts the external card ROM 32 into a card insertion slot 33 provided to the right side wall of the sewing machine 11.

In order to perform embroidery sewing and normal sewing, the control device 25 controls the various mechanisms of the sewing machine 11 based on the programs stored in the ROM 27 and based on the operation selected by the user pressing the touch panel 24. As will be clear by the following explanation, the control device 25 controls the LCD 23 to display a variety of pattern selection screens shown in FIGS. 5, 7, 8, 12, and 16 for displaying a plurality of individual patterns. The control device 25 displays these screens in the mode in which a user selects patterns he or she wishes to embroider. The user can select one or more patterns by touching the touch panel 24 to operate one of the pattern selection screens. Predetermined data for the selected embroidery patterns are then stored into predetermined memory regions of the RAM 28 in the order selected. Embroidery sewing operations are then performed in the order in which the patterns are selected.

When the sewing patterns are selected and the sewing machine 11 switch to its position edit mode, the control device 25 displays the position edit screen on the screen of the LCD 23. As shown in FIG. 8, a layout region A representing the embroidery forming region, that is, the embroiderable region as defined by the embroidery frame 18, of the workpiece cloth is shown encompassed by a frame in the lefthand portion of the LCD 23. Also, at least one selected pattern is displayed in the layout region A.

The user uses the layout region A to confirm the overall arrangement and inter-pattern spacing of the finished embroidery pattern. The size of each pattern and spacing between displayed patterns correspond to relative distances and dimensions of how the patterns will appear when embroidered on the embroiderable region of the workpiece cloth, that is, as defined by the embroidery frame 18. That is, the layout region A displays the overall sewing pattern as it will appear when actually sewn. A variety of key displays E, which are images of operation buttons, are displayed at the right side of the layout region A in the operatable portion of the touch panel 24.

By touching a key display E of the touch panel 24, the user can perform various editing processes on the selected pattern in the layout region A. For example, the user can move patterns, rotate patterns, change the size of patterns, that is, enlarged or reduced from standard sizes, or change the inter-character distance between patterns. The display of the patterns will be changed according to these editing processes. An image matching those embroidery patterns to be sewn into the workpiece cloth is displayed in the layout region A. The user views this image and can set a desired layout in which he or she wishes the embroidery pattern to be sewn.

A confirmation display region F is provided in the upper portion of the position edit screen. The confirmation display region F displays the pattern or pattern groups to be edited in a fixed size, regardless of the size at which the layout region A displays the patterns. For example, when a character or a symbol is displayed at the right side of the confirmation display region F, then the display of the pattern is set to a height of 16 dots. Accordingly, the confirmation display region F displays patterns, such as characters or symbols, in a sufficiently large and sufficiently detailed manner. Further, the confirmation display region F displays the indicated embroidery pattern presently being subjected to editing processes at a fixed position regardless of the position of the selected embroidery pattern in the actual embroiderable region. In this way, the details of the indicated embroidery pattern can be easily confirmed.

When the embroidery pattern displayed in the right side of the confirmation display region F is a picture pattern retrieved from the external card ROM 32, it will be displayed in the right side of the confirmation display region F at a fixed size regardless of whether the actual embroidery pattern is a large, medium, or small sized pattern. Display data stored in the external card ROM 32, or prestored in the ROM 27 for displaying the pattern selection screen is also used for displaying embroidery patterns in the confirmation display region F.

Next, a control program for performing the above-described operations will be explained while referring to the flowchart in FIG. 4.

Figure 18:
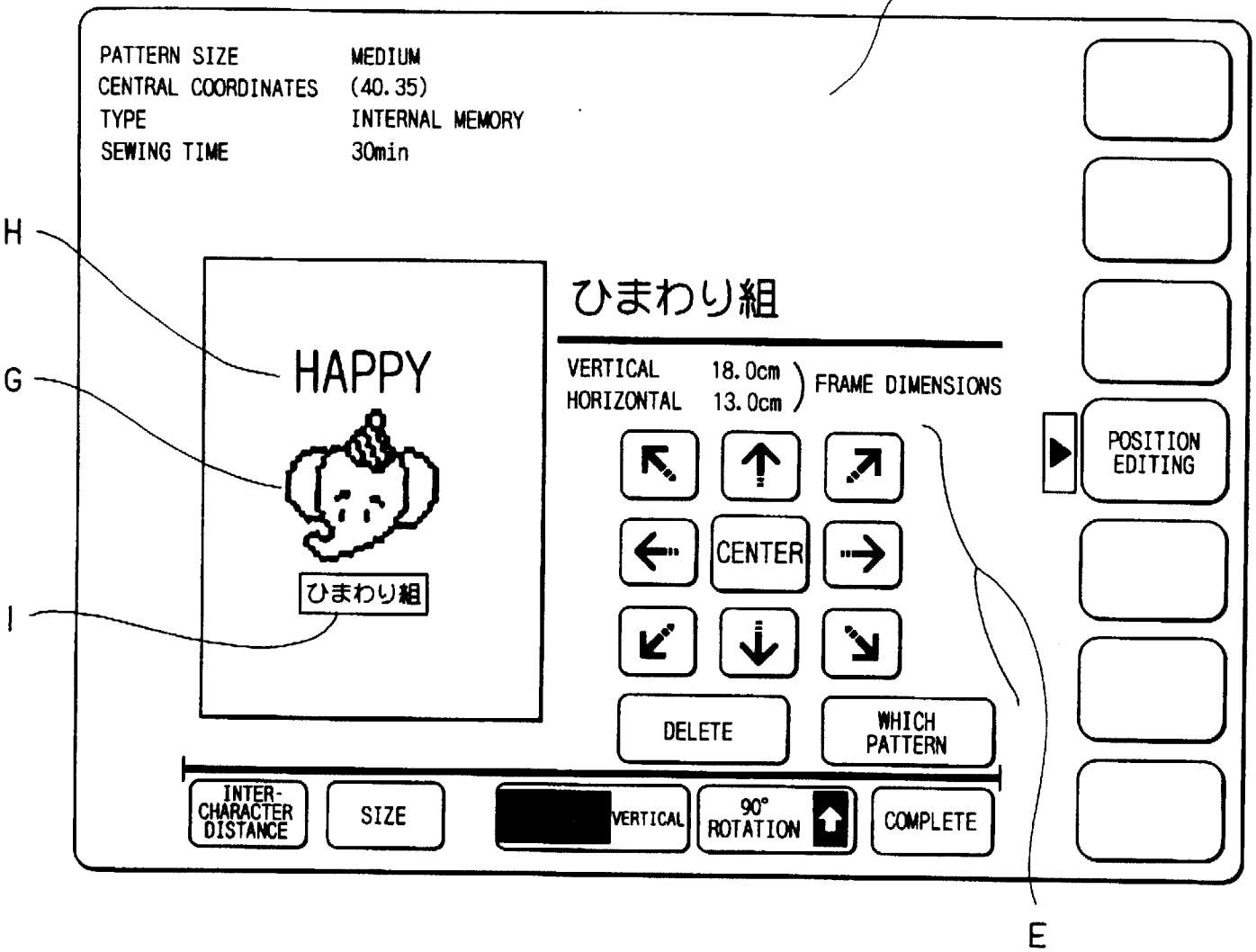
FIG. 18 is a schematic view showing the position editing screen when the "HIMAWARI GUMI" character group is the subject of editing processes.

The following example will be provided for when the embroidery patterns shown in the layout region A of FIG. 18 are to be sewn. In this example, three embroidery patterns G, H, and I are embroidered in the workpiece cloth in a vertical alignment. The picture embroidery pattern G is a picture pattern for an elephant and is embroidered in the center of the workpiece cloth in a medium size. The embroidery pattern H is character group pattern for embroidering the character train "HAPPY" in a relatively large size above the picture pattern G. The embroidery pattern group I is a character pattern group for embroidering the character train "HIMAWARI GUMI", which is Japanese for "sunflower group", in a relatively small size below the picture pattern G. Because the user may want the picture pattern G to be sewn in a plurality of colors, the data for the picture pattern G is configured for displaying and embroidering each color region separately. Each pattern G, H, and I is formed from subportions. For example, the character group pattern I is formed from the subportion patterns H, A, P, P, and Y. The picture pattern G is formed from the sub portion patterns for the elephant's face, hat, and outline. A large overall sewing pattern is configured from the three patterns G, H, and I. These patterns G, H, and I will be referred to as portion patterns and the combination of the three will be referred to as an overall sewing pattern hereinafter.

Portion patterns can be formed from a plurality of characters combined together or from a picture pattern. Both are treated as separate groups. Although character subportions can be combined with other character subportions to form character group patterns such as the character group pattern H, the subportions of picture patterns can not be separated or combined with other subportions. Embroidery data for each character pattern is provided with data for enabling the character pattern to form a single group with other character patterns. For example, letters can be combined to form words and phrases. On the other hand, embroidery data f or picture patterns is provided with data for preventing the embroidery pattern from forming a single group with character patterns. For example, the character train "HAPPY" will not combine with the elephant picture to form a single portion pattern.

Figure 4:
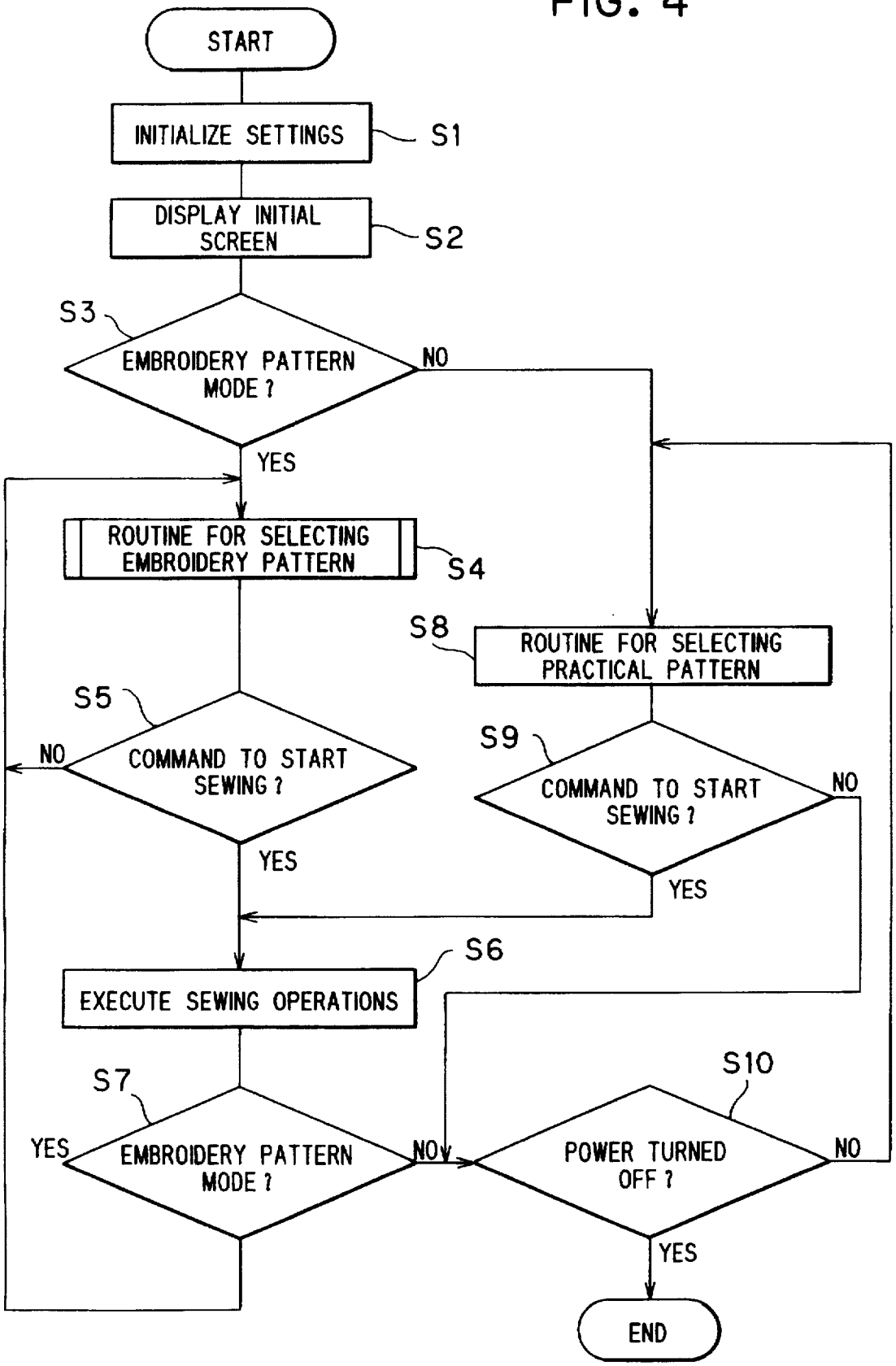
FIG. 4 is a flowchart representing a main routine of a central processing unit of the sewing machine.

At the start of the main program shown in FIG. 4, first, initialization processes are performed in S1 for setting initial values. Then, an initial screen, that is, a menu screen (not shown in the drawings) is displayed on the LCD 23 in S2. When the user wants to sew an embroidery pattern, he or she touches the touch panel 24 to select an embroidery mode. Whether or not the sewing machine 11 is set to the embroidery mode is determined in S3. If so (S3:YES), then a pattern selection routine for selecting one or more patterns is performed in S4. If not (S3:NO), then the routine proceeds to S8 (to be described later).

Figure 6:
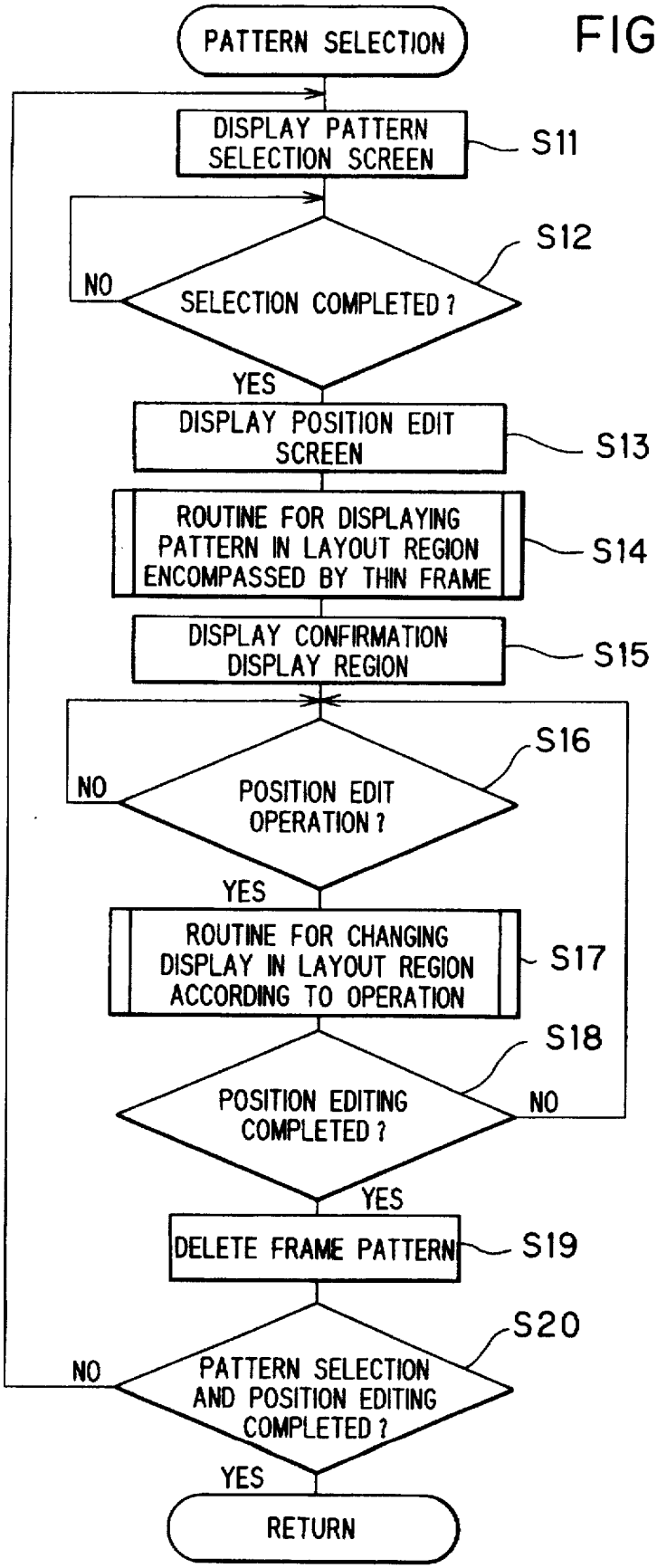
FIG. 6 is a flowchart representing a pattern selection routine of the sewing machine.

The routine of S4 will be explained in more detail while referring to the flowchart of FIG. 6. First, in S11, the pattern selection screen is displayed on the screen of the LCD 23. As shown in FIG. 5, the plurality of embroidery patterns are divided into eight different pattern types displayed in a selection area of the pattern selection screen. When the user touches a display key labeled "card" on the touch panel 24, the pattern selection screen on the LCD 23 will change to the screen shown in FIG. 7 for selecting a picture pattern. Here, a plurality of picture patterns, such as, a panda picture, an elephant picture, and a giraffe picture, are displayed on the screen based on the display data stored in the external card ROM 32.

In S12, the user views the pattern selection screen and selects an embroidery pattern he or she wishes to have embroidered. In this example, the pattern G for embroidering "elephant" has been selected. The user selects the pattern G of the touch panel 24 of the LCD 23 by touching the displayed portion directly with his or her finger. The pattern selection screen for selecting picture patterns spans a plurality of screen pages. When a desired pattern the user wishes to embroider is not shown on the presently displayed page, then the user can view a prior page or a subsequent page by touching the page turn buttons on the pattern selection screen.

When the user selects the picture pattern G (S12:YES), then in S13, a position editing screen shown in FIG. 8 is displayed on the LCD 23 so that the user can next perform position editing processes.

As described above, the position edit screen includes a layout region A representing the region on which a pattern can be embroidered on the workpiece cloth in the embroidery frame 18 and a variety of key displays E for displaying operation position of the touch panel 24.

Figure 10:
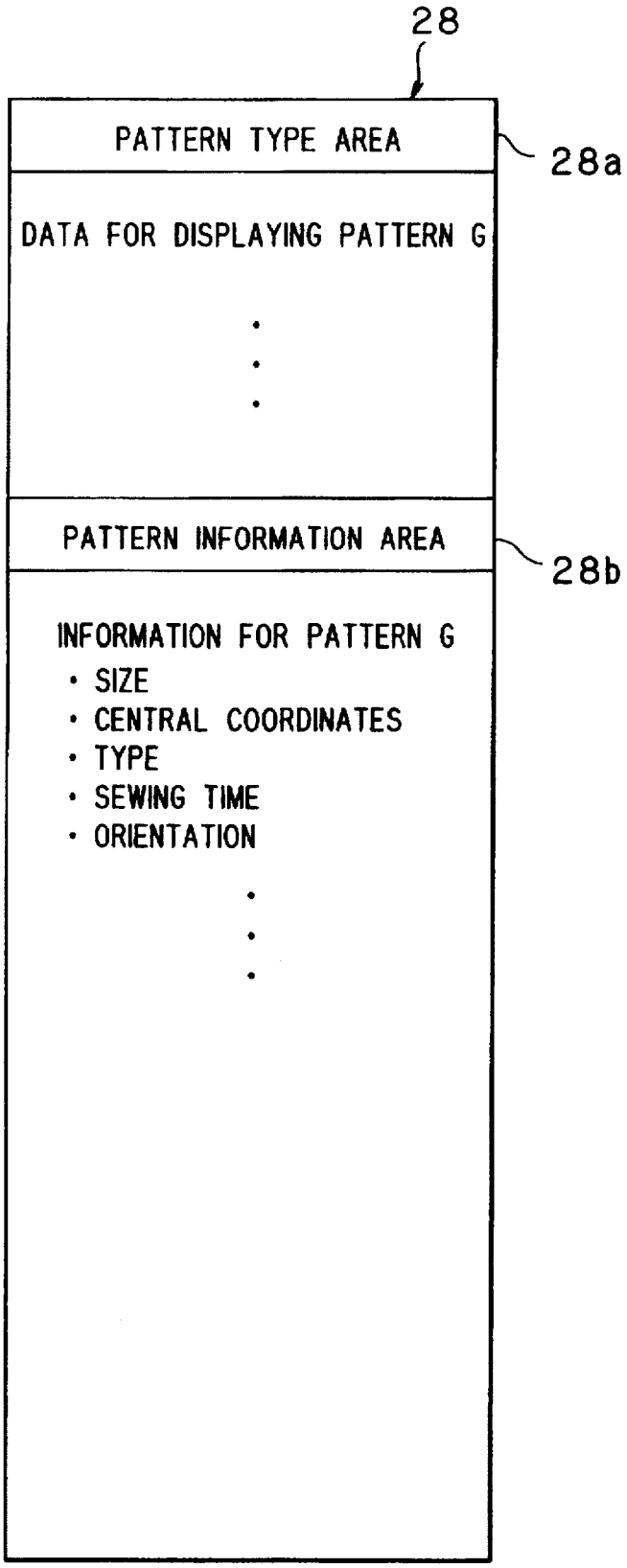
FIG. 10 is a schematic view showing storage areas in a RAM of the sewing machine after the elephant picture pattern has been selected.

When the user selects the elephant picture pattern G in S12, as shown in FIG. 10, various types of data, such as information and initial values, relating to the selected picture pattern G are stored in the predetermined order in a pattern type area 28*a* and a pattern information area 28*b* of the RAM 28. The data stored in a predetermined order includes data indicating the type of picture pattern (i.e., elephant), data indicating the size of the picture pattern (i.e., medium size), data indicating coordinates corresponding to the center of the embroidery pattern with respect to the embroidery frame (i.e., 40, 60, which are fixed initial values regardless of the embroidery pattern), data showing storage position of data for the picture pattern G (i.e., animal card), and data for indicating the sewing time required to sew the picture pattern G. Although a required sewing time of 30 minutes is prestored in this example, the required time could be calculated from the sewing data. In S14, the selected picture pattern G is displayed as shown in FIG. 8, in the center portion, that is, at coordinates (40, 60) of the layout region A encompassed by a thin frame, which indicates which pattern is presently the subject of editing processes. Although data for displaying this frame can be prestored in the RAM, in the present embodiment it is calculated in S14 to encompass the sewing pattern based on the sewing data.

Figure 9:
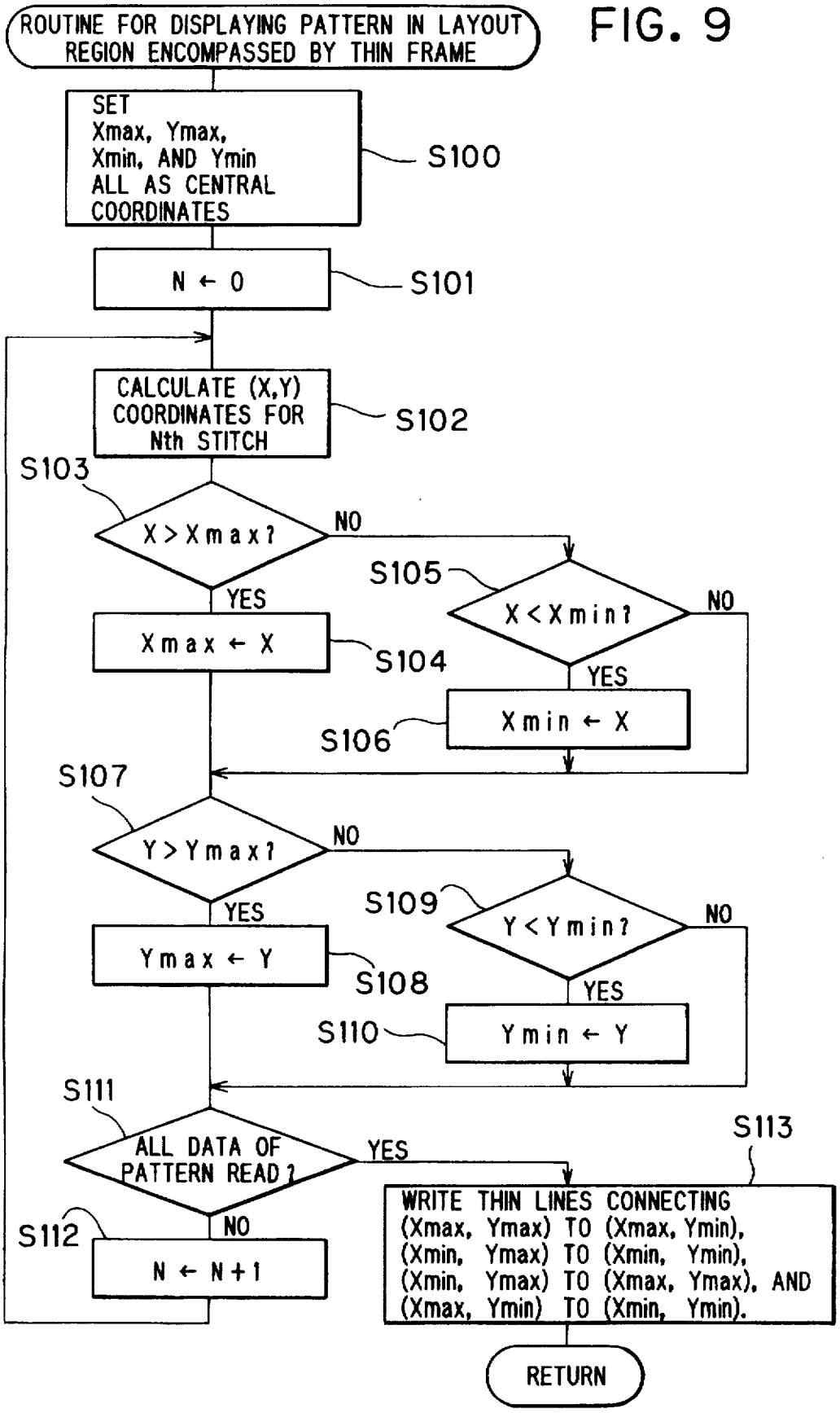
FIG. 9 is a flowchart representing a routine for displaying the present subject of editing processes encompassed by a thin frame.

The routine of S14 for displaying the selected pattern in the layout region A encompassed by the thin frame is represented by the flowchart in FIG. 9. In S100 through S112 of the flowchart, maximum and minimum values are determined for X-Y coordinates of stitch points forming the sewing pattern presently being edited. Then in S113, the four lines forming the rectangular shape of the thin frame are determined based on the maximum and minimum coordinate values determined in S100 through S112. The four lines are then displayed drawn as the thin frame.

Next, the routine for displaying the selected pattern in the layout region A encompassed by a thin frame will be described in more detail. First, in S100, initialization processes are performed on four values which will be used to determine the four corners of the thin frame. That is, a maximum X-axis value Xmax, a maximum Y-axis value Ymax, a minimum X-axis value Xmin, and a minimum Y-axis value Ymin, stored in the RAM are all set to the central coordinates of the layout region A. Next, in S101, a stitch counter storing a stitch number N, representing the number stitches that have to be processed in this routine, is initialized by setting the stitch number N to 0.

In S102, the X and Y coordinates for the Nth stitch, stitch 0 in this case, of the selected sewing pattern are calculated. Next, whether or not the X coordinate of the Nth stitch is greater than the maximum X-axis value Xmax is determined in S103. If so (S103:YES), then the maximum X-axis value Xmax is updated in S104 to the value of the X coordinate and the routine proceeds to S107. If not (S103:NO), then whether or not the X coordinate of the Nth stitch is less than the minimum X-axis value Xmin is determined in S105. If so (S105:YES), then the minimum X-axis value Xmin is updated to the value of the X coordinate in S106 and the routine proceeds to S107. If the X coordinate of the Nth stitch is greater than or equal to the minimum X-axis value Xmin (S105:NO), then the routine proceeds directly to S107.

In S107, whether or not the Y coordinate of the Nth stitch is greater than the maximum Y-axis value Ymax is determined. If so (S107:YES), then the maximum Y-axis value Ymax is updated in S108 to the value of the Y coordinate and the routine proceeds to S111. If not (S107:NO), then whether or not the Y coordinate is less than the minimum Y-axis value Ymin is determined in S109. If so (S109:YES), then the minimum Y-axis value Ymin is updated in S110 to the value of the Y coordinate of the Nth stitch and the routine proceeds to S111. If the Y coordinate is greater than or equal to the minimum Y-axis value Ymin (S109:NO), then the routine proceeds directly to S111.

In S111, whether or not processes have been performed for all stitches of the selected sewing pattern is determined by comparing the stitch number N in the stitch counter with the total number of stitches in the selected pattern. If not (S111:NO) then the stitch number N is incremented by one and the routine returns to S102 until data for all stitches has been processed. If so (S111:YES), then in S112 the maximum X-axis value Xmax, the maximum Y-axis value Ymax, the minimum X-axis value Xmin, and the minimum Y-axis value Ymin are used to determine corner coordinates (Xmax, Ymax), (Xmax, Ymin) (Xmin, Ymax), and (Xmin, Ymin) of the rectangular thin frame. The corner coordinates are connected by thin lines so that the thin frame is completed. The program then returns to S15 of the pattern selection routine of FIG. 6.

A confirmation display region F is displayed in the upper half of the LCD 23 in S15. As shown in FIG. 8, in this example an overall image of the picture pattern G and each of its different colored regions are displayed at the right side of the confirmation display region F in a predetermined fixed size. Also, pattern information relating to the picture pattern G is displayed in text form at the left side of the confirmation display region F. The text display of pattern information indicates contents of the data stored for the picture pattern G in the pattern information area 28*b*. The confirmation display region F is displayed with the layout region A, which is for displaying the form of the embroidery patterns. In a household sewing machine, when multi-color sewing is to be performed by changing thread colors, the sewing machine automatically stops after sewing one color region so that the user can change the thread color to the next desired thread color and then restart sewing operations. Such is the case of the sewing machine of the present embodiment. The sewing machine 11 will automatically stop according to data stored either in the ROM 27 or the external card ROM 32 for separating the different color regions. This multi-color sewing function can be turned off so that sewing can be performed in one color without the sewing machine stopping at the end of each different colored region.

The user can designate desired position editing operations, such as, rotating or moving the picture pattern G by pressing the key displays E of the touch panel 24 while viewing the position editing screen. When the user presses the touch panel 24 (S16:YES), then in S17, the display of the picture pattern G is moved or rotated in the layout region A according to the pressed display key. Data stored in the pattern information area 28b is serially updated in correspondence with these operations.

Figure 11:
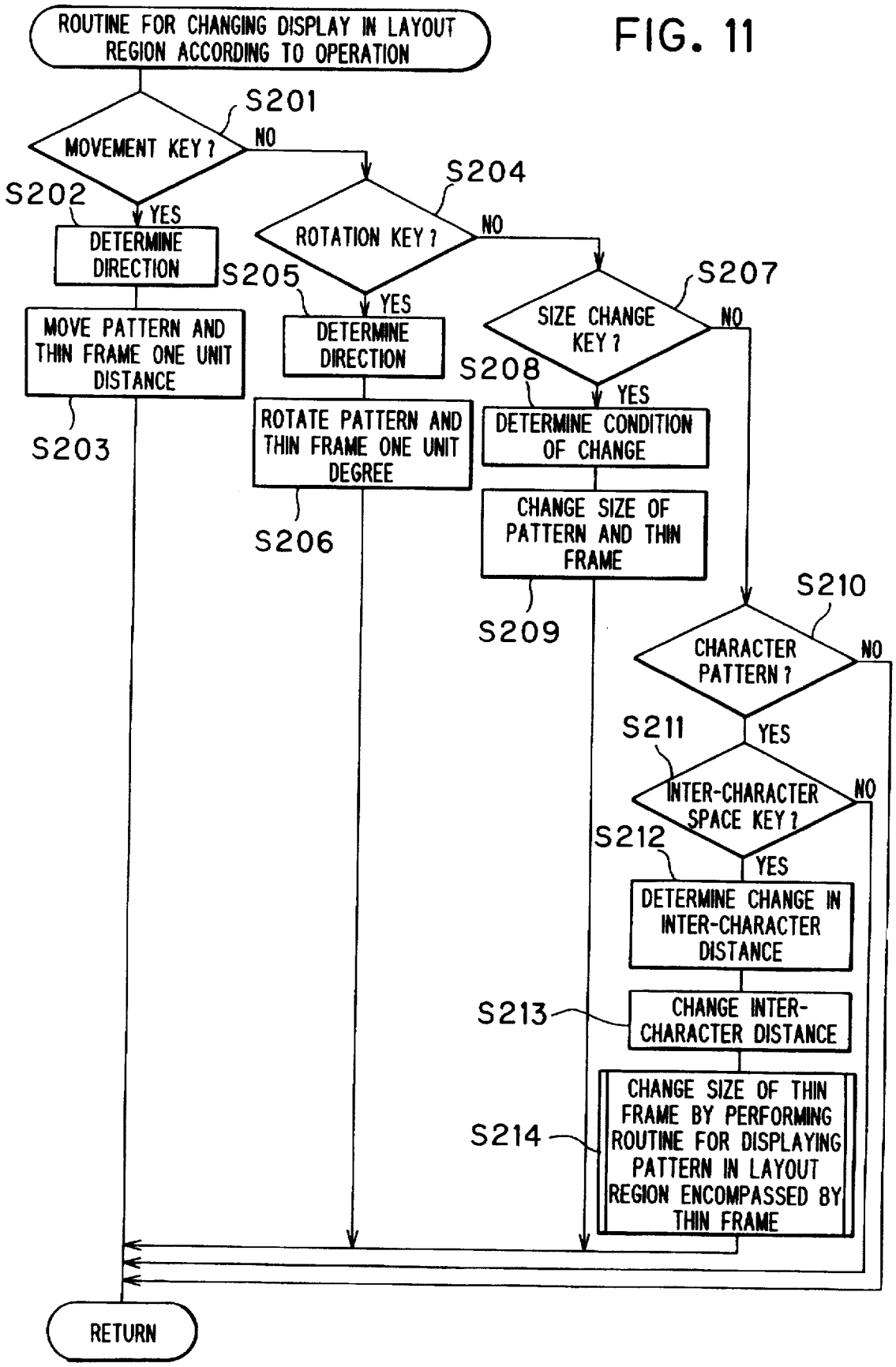
FIG. 11 is a flowchart representing a routine for changing display according to operations performed by a user.

The routine for changing display in the layout region performed in S17 will be described in more detail while referring to the flowchart in FIG. 11. First, whether or not one of the cursor movement keys has been operated is determined in S201. If so (S201:YES), then the direction of the operated cursor movement key is determined in S202. Next, in S203, the presently indicated pattern and thin frame encompassing it are moved one unit distance in the direction of the operated cursor movement key. Afterward, the program returns to S18 of the flowchart in FIG. 6.

If a cursor movement key has not been operated (S201:NO), then whether or not a rotation key has been operated is determined in S204. If so (S204:YES), then the direction of rotation is determined in S205. Next, in S206, the presently indicated pattern and thin frame encompassing it are rotated one unit degree in the indicated direction. Afterward, the program returns to S18 of the flowchart in FIG. 6.

If the rotation key has not been operated (S204:NO), then whether or not the size change key has been operated is determined in S207. If so (S207:YES), then the condition of the desired change, that is, whether the size of the sewing pattern is to be enlarged or reduced and by what degree, is determined in S208. Next, in S209, the size of the presently indicated pattern and of the thin frame are changed in the manner determined in S208. Afterward, the program returns to S18 of the flowchart in FIG. 6.

If the size change key has not been operated (S207:NO), then whether or not the presently indicated sewing pattern is a character pattern is determined in S210. If not (S210:NO), then the program returns to S18 of the flowchart in FIG. 6. If so (S210:YES), then whether or not the inter-character space key has been operated is determined in S211. If so (S211:YES), then the change in inter-character distance is determined in S212, the inter-character distance is changed accordingly in S213, and the size of the thin frame encompassing the character pattern is also changed accordingly in S214. It should be noted that the size of the thin frame is changed in S214 using the same process described with reference to the flowchart in FIG. 9. Afterward, the program returns to S18 of the flowchart in FIG. 6.

When the user confirms that the position of the picture pattern G is as he or she desires, such as in the center of the layout region A in this example (S18:YES), then it is determined that editing processes for the picture pattern G are completed so that the thin frame encompassing the picture pattern G will be deleted in S19. If some patterns still remain unselected or unedited (S20:NO), then the program returns to S11 so that the display of the LCD 23 will return to the screen shown in FIG. 5. When the user wants to select the next pattern H "HAPPY", then he or she will select the key display "ABC", or "ABC" depending on the font that he or she prefers. As a result, the alphabet pattern selection screen shown in FIG. 12 will be displayed on the LCD 23. The user then inputs the character subportion patterns "H", "A", "P", "P", and "Y", in this order, by pressing the corresponding key displays.

Figure 13:
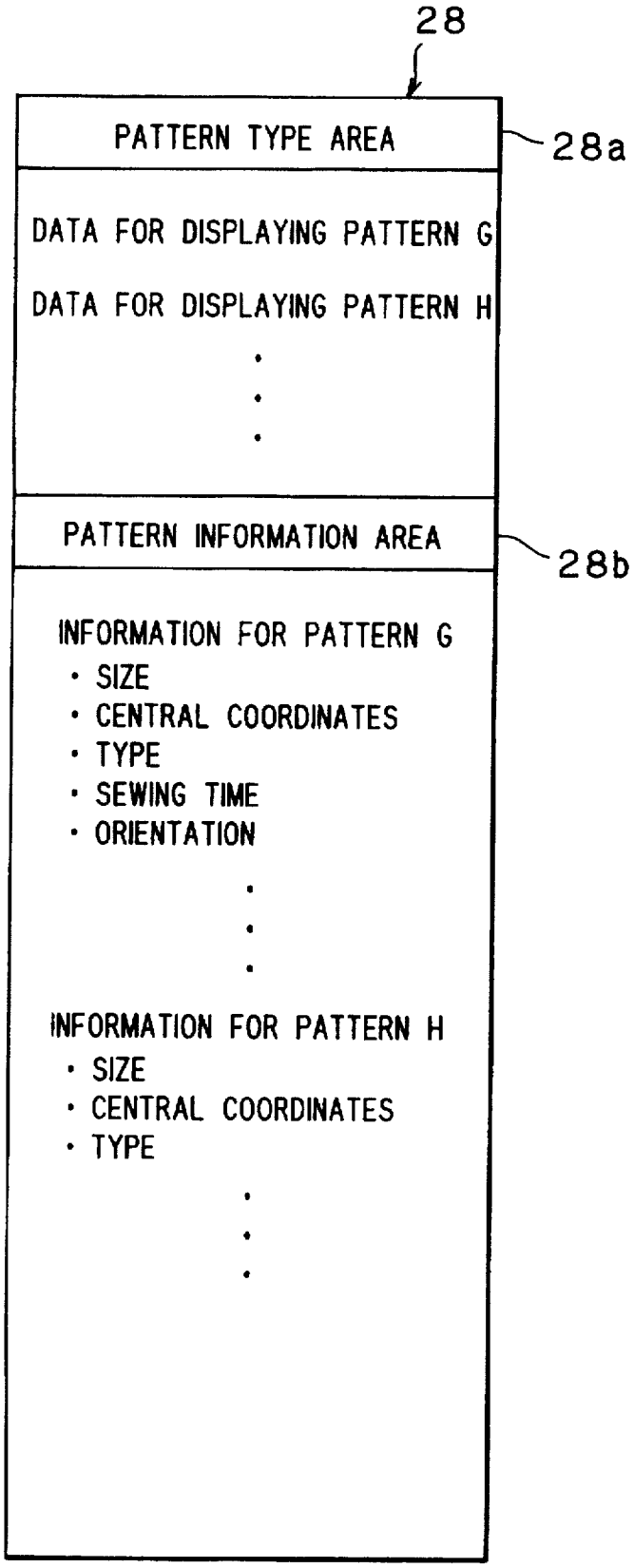
FIG. 13 is a schematic view showing storage areas in a RAM after the "HAPPY" character group has been selected.
Figure 14:
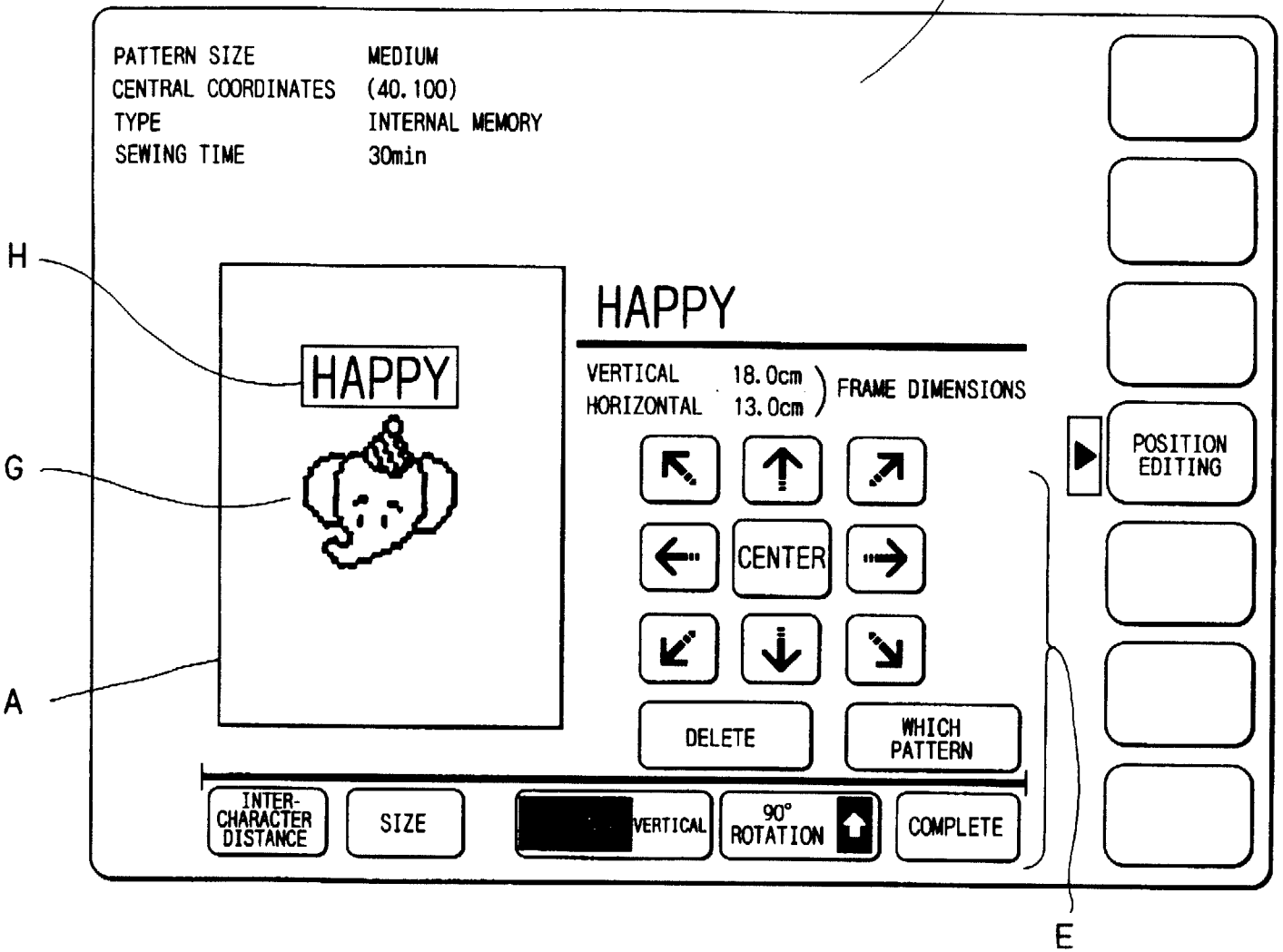
FIG. 14 is a schematic view showing the position editing screen when the "HAPPY" character group is the subject of editing processes.

When the user finishes selecting and confirming the "HAPPY" character group pattern H (S12:YES), then in S13 to S15 the position edit screen shown in FIG. 14 is displayed on the LCD 23. Also, as shown in FIG. 13, the data relating to the character group pattern H is serially stored in the pattern type area 28a and the pattern information area 28b after data relating to the picture pattern G. As shown in FIG. 14, in addition to the picture pattern G already positioned in the layout region A, the "HAPPY" character group pattern H, which was selected this time, is added to the position edit screen and displayed in S13 and S14 encompassed by the thin frame to indicate that it is presently the subject of editing processes. At this time, the picture pattern G is not displayed encompassed by the thin frame. In other words, the pattern which is the subject of editing processed is displayed in a different display form than other patterns so that the subject pattern stands out from the other patterns.

Figure 12:
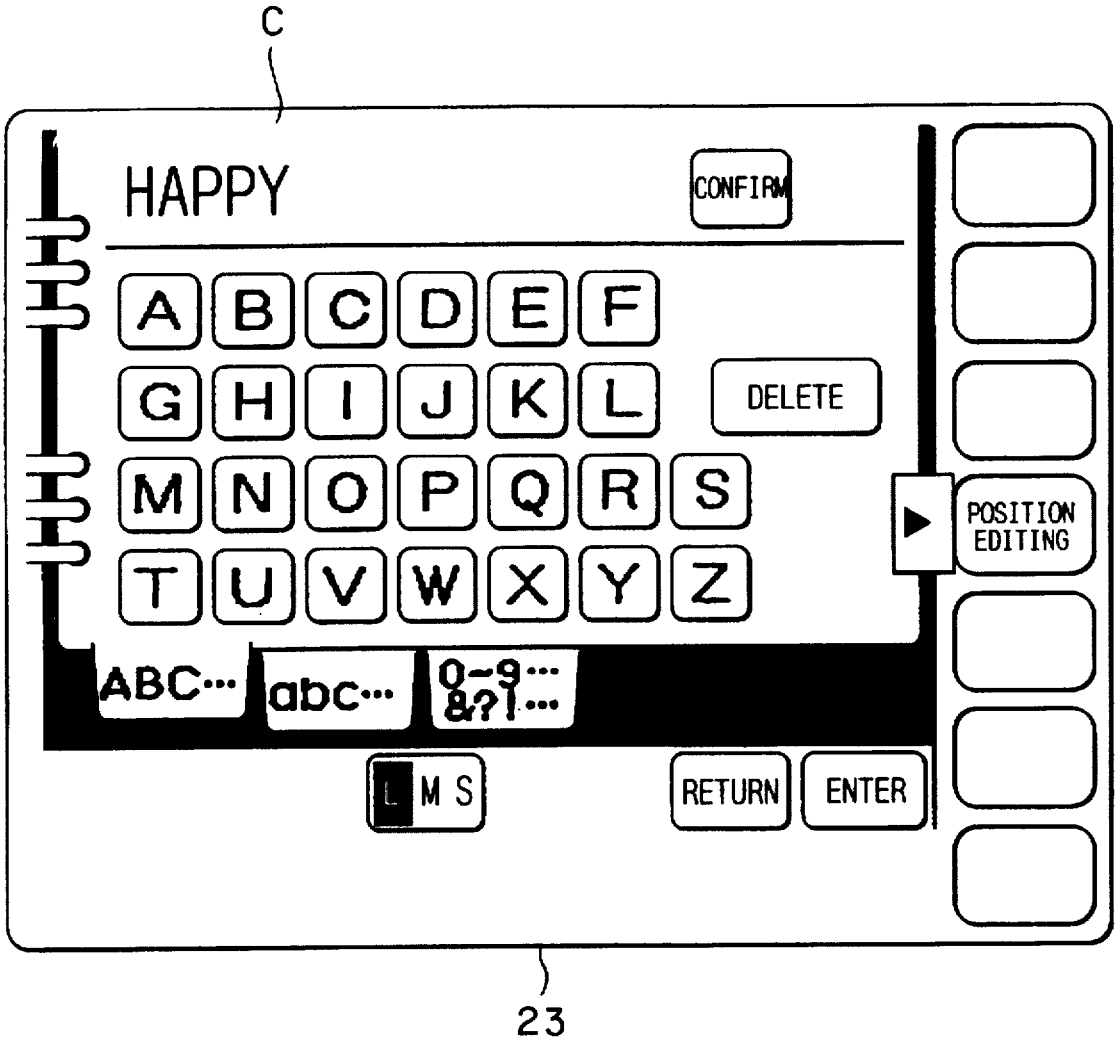
FIG. 12 is a schematic view showing an alphabetic character pattern selection screen when a "HAPPY" character group has been selected.

As shown in FIG. 14, in S15, the shape of the pattern presently subject to editing processes, that is, the "HAPPY" character group pattern H and character information, such as the central position and size of the pattern, are displayed in the upper left area of the confirmation display region F of the LCD 23. The display data for displaying the pattern in the selection screen of FIG. 12 is used as is for the pattern shown in the confirmation display region F. Accordingly, the characters for the character train "HAPPY" displayed in a predetermined fixed size. It should be noted that the display can be designed so that when a long character train is the subject of editing processes, it can be displayed in the confirmation display region F in a scrolling manner.

Next, during S16 and S17, the user performs editing processes on the character group pattern H in the layout region A by operating the touch panel 24 using the key displays E. For example, the user can, by operating the key displays E, rotate the character group pattern H, move the character group pattern H, change the size of the character group pattern H, that is, enlarge it or reduce it from a standard size, or change the inter-character distance of the character group pattern H. FIG. 14 shows the arrangement of the embroidery patterns G and H after the user has pressed the upward movement arrow of the key displays E, which are displayed in the right side of the LCD 23, to move the character group pattern H above the picture pattern G. When the user moves the character group pattern H in this way so that the central coordinates of the character group pattern H change from their initial values, the data for the character group pattern H will be automatically updated in the character information area 28b.

When the position editing processes for the character group pattern H are completed, then in S19, the thin frame is removed from around the character group pattern H.

Next, an explanation for when the user selects and changes position of the "HIMAWARI GUMI" character group pattern I will be provided. It should be noted that the Japanese language includes three types of written characters: katakana, hiragana, and kanji. Hiragana and katakana, referred to collectively as kana, include characters representing the members of the Japanese syllabary, or alphabet. Kanji, or Chinese characters as they are often referred, are ideograms pronounced using one or more of the Japanese syllabary. Katakana, hiragana, kanji, and alphanumeric characters are referred to collectively as characters in this specification.

The members of the Japanese syllabary are divided into 10 groups by pronunciation, for example, the a group, the ka group, and the ha group. The a group includes the five vowel members a, e, i, o, and u. The ka group includes the k-consonant members ka, ke, ki, ko, and ku, and also the g-consonant members ga, ge, gi, go, and gu. The ha group includes the h-consonant members ha, he, hi, ho, and hu, the p-consonant members pa, pe, pi, po, and pu, and the b-consonant members ba, be, bi, bo, and bu.

Figure 15:
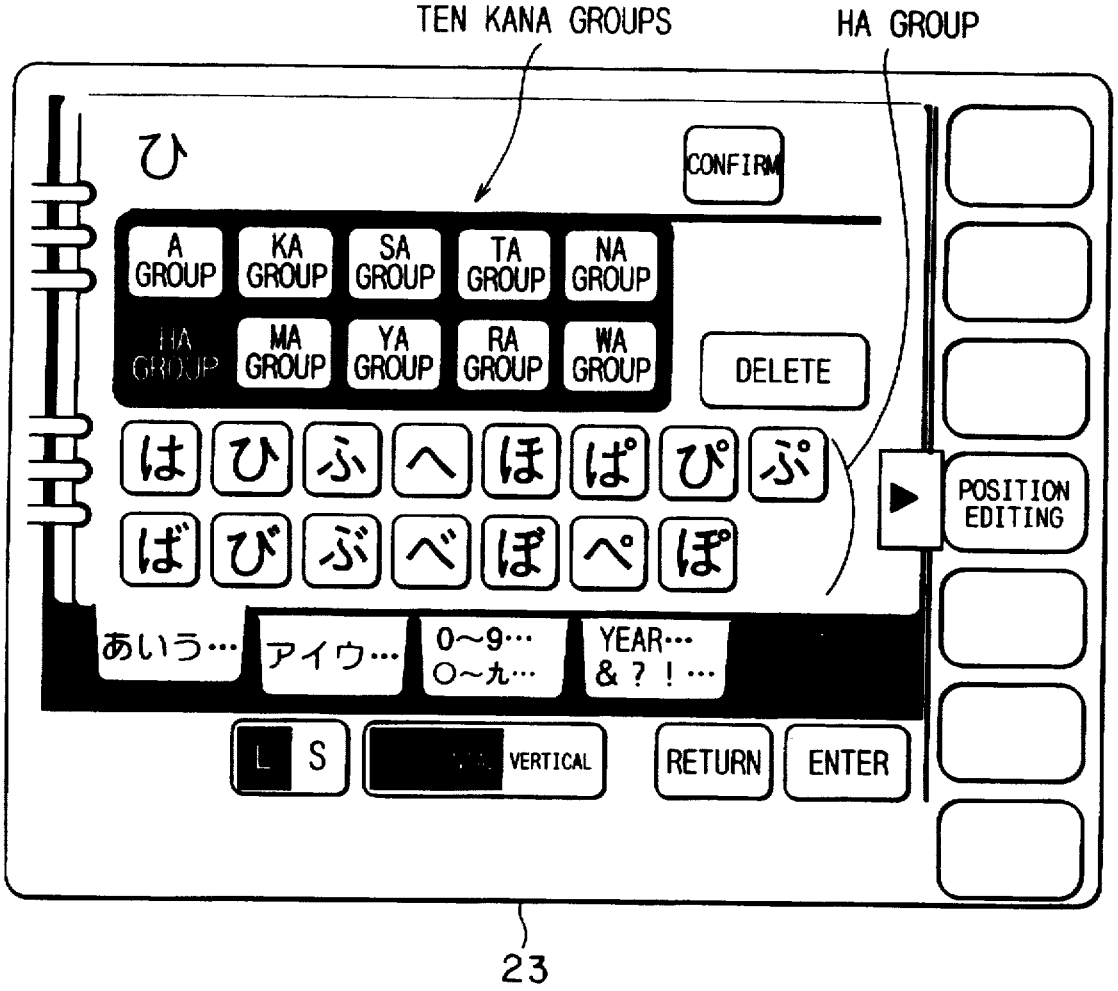
FIG. 15 is a schematic view showing a Japanese kana character pattern selection screen.
Figure 16:
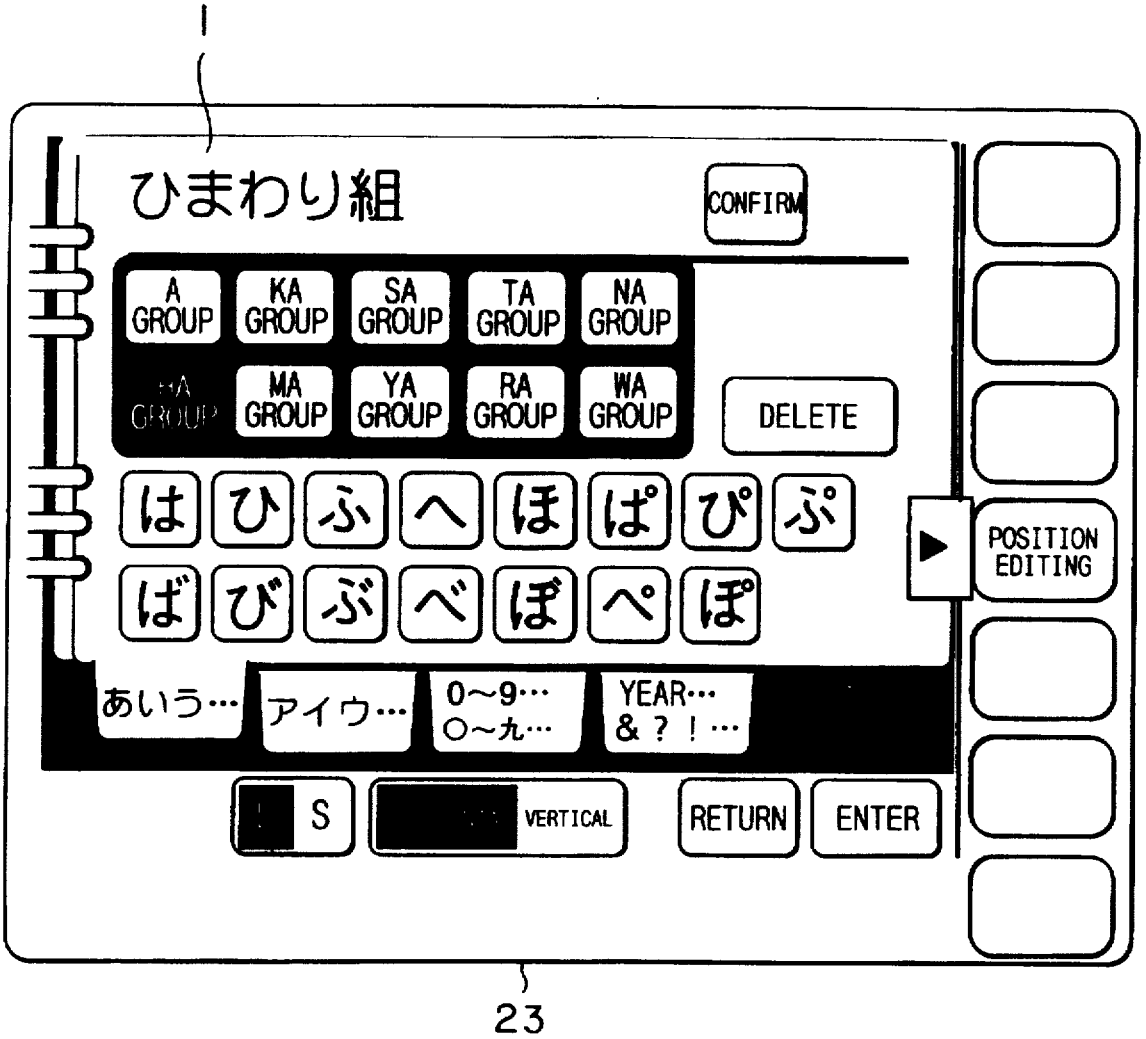
FIG. 16 is a schematic view showing the Japanese kana character pattern selection screen after a "HIMAWARI GUMI" character group has been selected.
Figure 17:
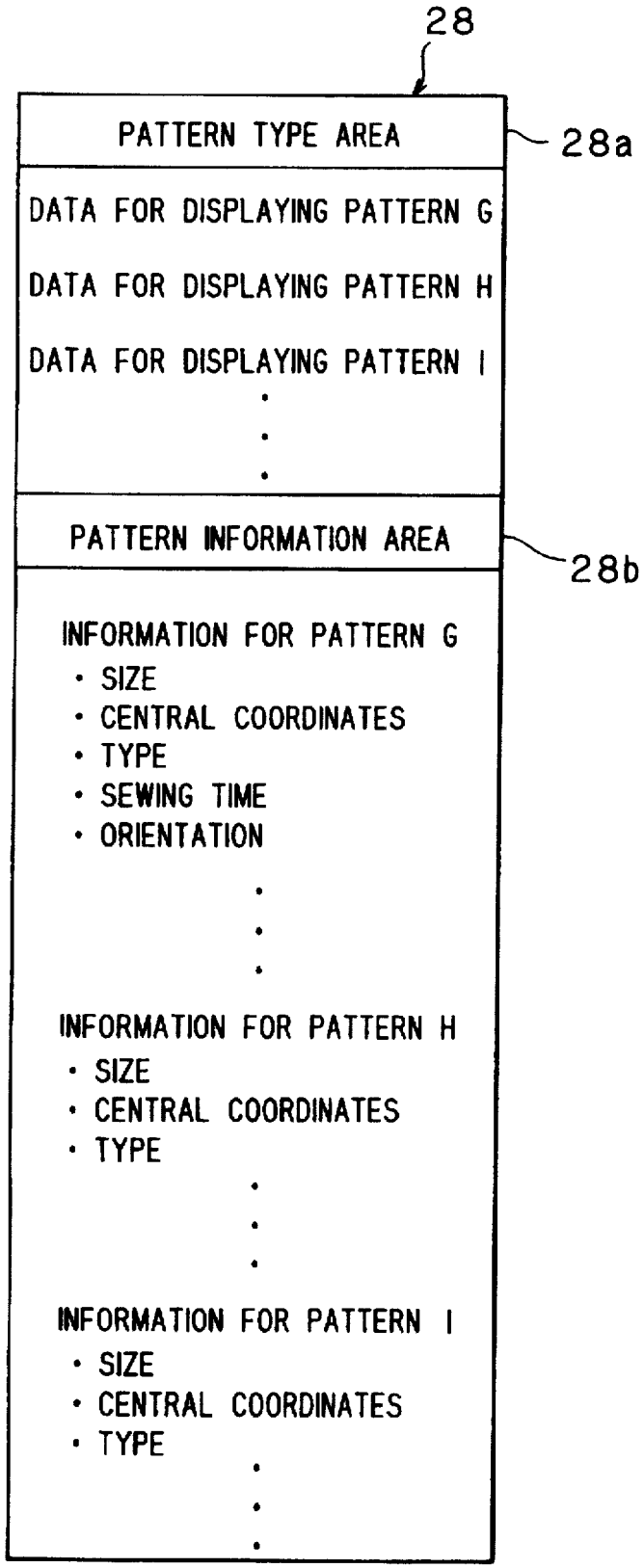
FIG. 17 is a schematic view showing storage areas in a RAM after the "HIMAWARI GUMI" character group has been selected.

When the user presses one of the kana display keys in the pattern type selection screen of FIG. 5, then the ten kana groups will appear in the upper left side of the selection screen as shown in FIG. 15. To select the "hi" hiragana character pattern, first user selects the "ha group" from the ten kana groups so that all of the members of the "ha group" are displayed in the middle of the screen. The user then selects the "hi" subportion pattern. In the same manner, the user then enters the rest of the hiragana subportion patterns "MA", "WA", "RI", "GU", "MI" in this order to complete input of the "HIMAWARI GUMI" character group pattern I as shown in the upper left corner of FIG. 16. The data in the RAM 28 will appear as shown in FIG. 17. It should be noted that the character train "GUMI," which is Japanese for "group", is represented by kanji in the present embodiment, although it could be represented by kana.

When the user completes selection of the "HIMAWARI GUMI" character group pattern I (S12:YES), then the position editing screen is displayed on the LCD 23 in S13 to S15. As shown in FIG. 18, the "HIMAWARI GUMI" character group pattern I is displayed in the layout region A along with the previously arranged elephant picture pattern G and "HAPPY" character group pattern H. The "HIMAWARI GUMI" character group pattern I selected this time is displayed encompassed by the thin frame to indicate that it is the pattern presently being subjected to editing processes. At this time, the patterns G and H are not displayed encompassed by the thin frame. The "HIMAWARI GUMI" character group pattern I is to be sewn in a small size, and so is displayed in a small size in the layout region A. However, because the LCD 23 itself is small, the display of the "HIMAWARI GUMI" character group pattern I is difficult for the user to read in the layout region A. Therefore, the "HIMAWARI GUMI" character group pattern I is displayed at the right side of the confirmation display region F in a size easily readable by the user. Also, text relating to the editing content of the character group pattern I is displayed at the left side of the confirmation display region F. In this way, the characters group pattern I, which is presently being subjected to editing processes, is displayed in the confirmation display region F in a manner so its details are more easily understandable than in the layout region A. It should be noted that the content of the character display is stored in updatable form in the RAM 28 in the same way described above for the patterns G and H.

When the user touches the key displays E of the touch panel 24, display editing processes are performed on the character group pattern I in the layout region A accordingly in S16 and S17. As shown in FIG. 18, the "HIMAWARI GUMI" character group pattern I is positioned below the elephant picture pattern G and is displayed in a size reduced smaller than the standard size. This means that it will be embroidered in a small size.

Although detailed explanation will be omitted, when the selection and position editing processes have been completed for each of the patterns, then embroidery data is produced by the control device 25. The user then sets the workpiece cloth in the embroidery frame 18 and presses the start/stop key 21, whereupon an embroidery sewing operation is executed based on data relating to the embroidery pattern in the RAM 28, on data in the external card ROM 32, and the data in internal ROM 27. An embroidery pattern conforming to the image displayed in the layout region A is sewn onto the workpiece cloth. The embroidery patterns are sewn in the order inputted. Further, so that the user can change the thread color, the sewing machine will automatically stop temporarily after each pattern is completed. In this example, the sewing machine will stop sewing after each different colored region of the "elephant" picture pattern G is completed. The sewing machine stops and waits for the input from the start/stop key 21. This is repeated until the picture pattern G is completed. Then the sewing machine will again temporality stop automatically. When the sewing machine is next started, the "HAPPY" character group pattern H will be sewn in a series of separate sewing operations i.e. One sewing operation for each character of the character group. The sewing machine will then again stop and wait for the start/stop key 21 to be operated. After input of a start signal from the start/stop key 21, the "HIMAWARI GUMI" character group pattern I will be sewn in a series of sewing operations. Afterward, the sewing machine will stop for the final time. In other words, the sewing machine 11 sews the overall sewing pattern by dividing it into a plurality of consecutive sewing operations corresponding to a pattern number stored in the pattern type area 28*a*.

Control operations for controlling the above-described sewing operations are represented in the flowchart of FIG. 4. When the user operates the start/stop key 21 (S5:YES), then sewing operations are executed in S6. After sewing operations are completed, whether or not the sewing machine 11 is presently set to the embroidery pattern mode is determined in S7. If so (S7:YES), then whether or not the power switch 22 has been switched off is determined in S11. If so (S10:YES), then this program ends. If not (S10:NO), then the routine returns to S4. If not (S7:NO), then the routine proceeds to S8. In S8, a routine is performed for selecting practical sewing patterns such as zigzag stitching and the like. When the start/stop key 21 is operated (S9:YES), then the program proceeds to S6, whereupon sewing operations are performed for the practical pattern or patterns selected in S8. When the start/stop key is not operated, then the program proceeds to S10.

The LCD 23 used in the present embodiment is an inexpensive, monochrome display device. However, multicolor patterns, such as the picture pattern G, which are supposed to be sewn in a plurality of colors, are displayed as both an overall image in the layout region A and as different colored regional images in the confirmation display region F. Therefore, the overall sewing pattern and the different colored subpatterns can be easily grasped so that the embroidery pattern can be more easily understood.

As described above, the portion pattern subjected to editing processes can be easily and visually determined because it is encompassed by a thin frame, while the other patterns are not. The portion pattern subjected to editing can be either displayed in a darker or lighter manner than other patterns to facilitate its identification. In this case also, display of patterns can be performed using a simple monochrome display device. For example, the subject embroidery pattern can be displayed in full tone density while those patterns not subjected to editing processes can be displayed in a thin halftone pattern. In this way, the subject pattern will stand out more. Alternatively, the embroidery pattern being subjected to the editing processes can be displayed to blink so that it will stand out more.

Figure 19:
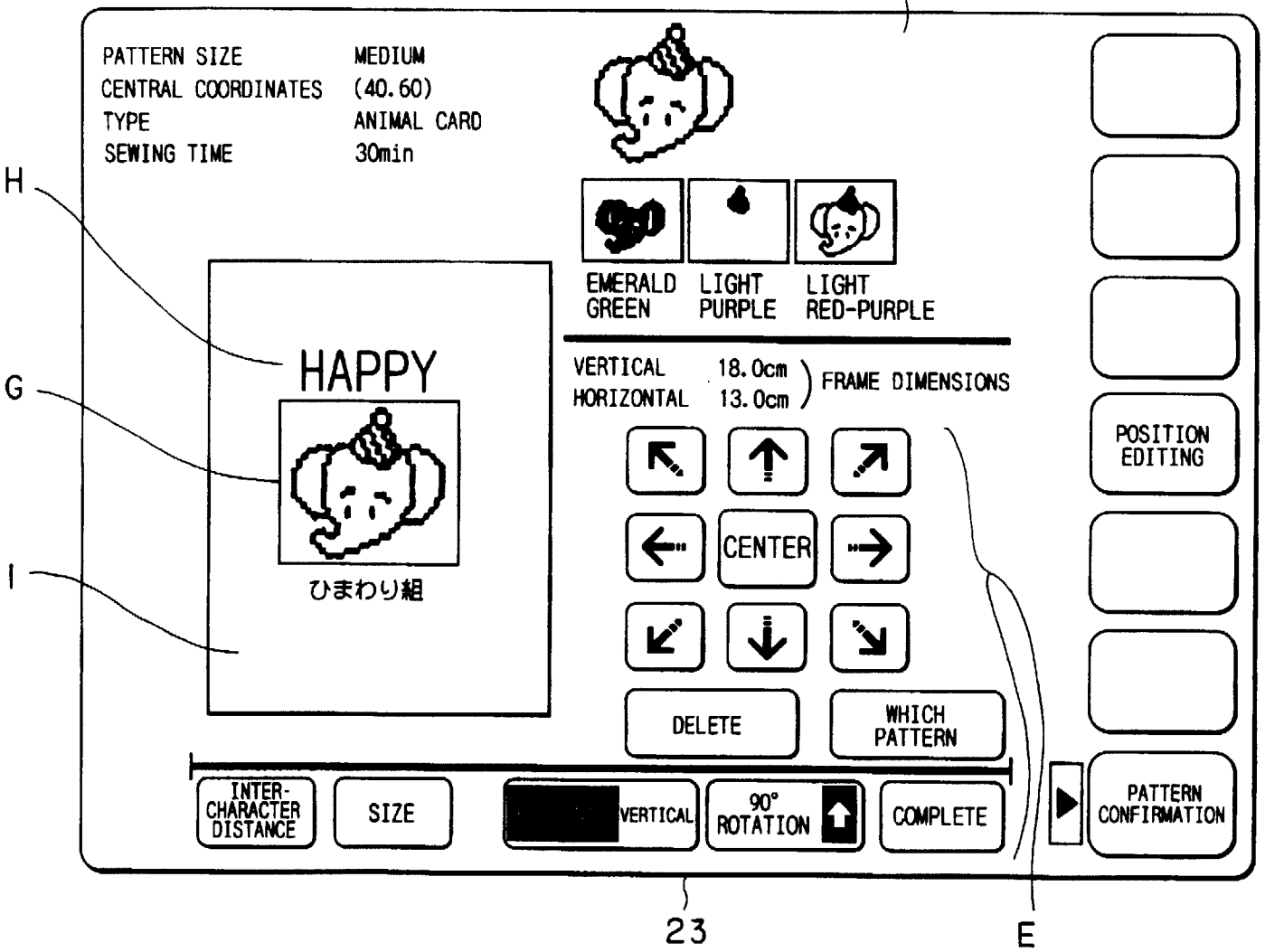
FIG. 19 is a schematic view showing the position editing screen of the sewing machine after the elephant picture pattern, the "HAPPY" character group, and the "HIMAWARI GUMI" character group have been selected and the elephant picture pattern is the subject of editing processes.

Also, the layout region A is displayed on the LCD 23 in a size smaller, that is, approximately half size in the vertical and horizontal dimensions, than the actual size of the embroidery portion of workpiece cloth as defined by the embroidery frame 18. Accordingly, patterns G, H, I are displayed in sizes smaller than the size at which they will be embroidered into the workpiece cloth. As shown in FIG. 19, because the "HIMAWARI GUMI" character group pattern I is set to be sewn in a relatively small size, the "HIMAWARI GUMI" character group pattern I will be displayed in a small size in the layout region A. Also, the number of dots used to display each character pattern will be reduced so that the patterns can become distorted and difficult to discern.

In the present embodiment, the confirmation display region F is provided to the upper right portion of the position editing screen. The subject pattern group is displayed in S15 in the confirmation display region F in a fixed size sufficiently large to visually recognize. Therefore, patterns set to be embroidered in the small embroidery sizes will be displayed in a magnified size in the confirmation display region F. Accordingly, even though the pattern I appears distorted when displayed in the layout region A, it will be clearly displayed in the confirmation display region F so the user can confirm its content by viewing the confirmation display region F. Should the user determine by viewing the left side of the confirmation display region F that the pattern differs from the pattern he or she desires, the user can return to the selection pattern screen and reinput the pattern I. Further, should the user, by viewing the left side of the confirmation display region F, determine that the editing content relating to the pattern I is not as he or she desires, then the user can return to the editing screen to change editing content as desired.

Although in the present embodiment the subject sewing pattern is displayed in the layout region A in a fixed size, when the sewing pattern display device has a large display, the subject embroidery pattern presently can be displayed in a larger size than the other embroidery patterns so that it stands out.

In the present embodiment, the subject sewing pattern is displayed in a fixed position, that is, in the confirmation display region F. However, the selected sewing pattern can be displayed in a pop-up format at an optional position on the display device. Further, the device can be designed so that the pop-up display moves with the sewing pattern when the sewing pattern is moved.

In the above-described embodiment, during the editing operations performed after selection of the pattern, the pattern which is presently the subject of editing processes is displayed so as to stand out from the other patterns. After all the patterns G, H, I are selected as shown in FIG. 19, the user can again indicate any one of the patterns and then again perform editing process on the selected pattern. A pattern can be indicated based on data stored in the pattern type area 28*a*.

In order to enable a user to confirm accuracy of information and form of the subject embroidery pattern, it is conceivable to design a pattern display device so that the user could operate a key to switch to a screen indicating only the information on the selected pattern. However, this would require the user to perform extra operations. Also, because the overall sewing pattern would not be displayed while the user is viewing the desired embroidery information, the user will lose grasp of the overall sewing pattern. Because in the present embodiment, the overall image is constantly displayed in the layout region A while information on the region desired to be known by the user is displayed in the confirmation display region F, which is provided separately from the layout region A and sometimes in a magnified display, therefore the user need not perform any extra operations and is always able to confirm portions of the overall image while maintaining a good grasp of the overall sewing pattern.

In the present embodiment, the layout region A is provided to the position editing screen of the LCD 23. The patterns G, H, and I are displayed in a composite image representing the completed embroidery form in the layout region A. Because the region occupied by the subject pattern and information of the subject embroidery pattern are displayed on the same screen with the overall sewing pattern including the patterns G, H, and I, the user can look at the confirmation display region F and can confirm at once both the overall sewing pattern and the content of editing processes performed thereon.

Because the pattern display data stored in the ROM 27 for use as display data for the pattern selection screen is also used as display data for the confirmation display region F, there is no need to separately store or calculate display data for all the patterns for the confirmation display region F. Therefore, the memory capacity can be more effectively used. Also, time required for process of calculations can be shortened.

Conventionally, when editing embroidery patterns, the user must subjectively determine size of patterns, take written notes about the size of pattern, or memorize patterns while editing them. This often leads to mistakes and also places an added burden on the user. On the other hand, the sewing pattern display device of the present invention displays text on the size of indicated patterns. Therefore, one of three sizes, large, medium, and small, can be selected for the size of the pattern. By indicating this pattern, the user can easily and reliably determine the size of the pattern so that he or she makes fewer mistakes when editing the pattern. Also editing the pattern becomes easier.

Figure 20:
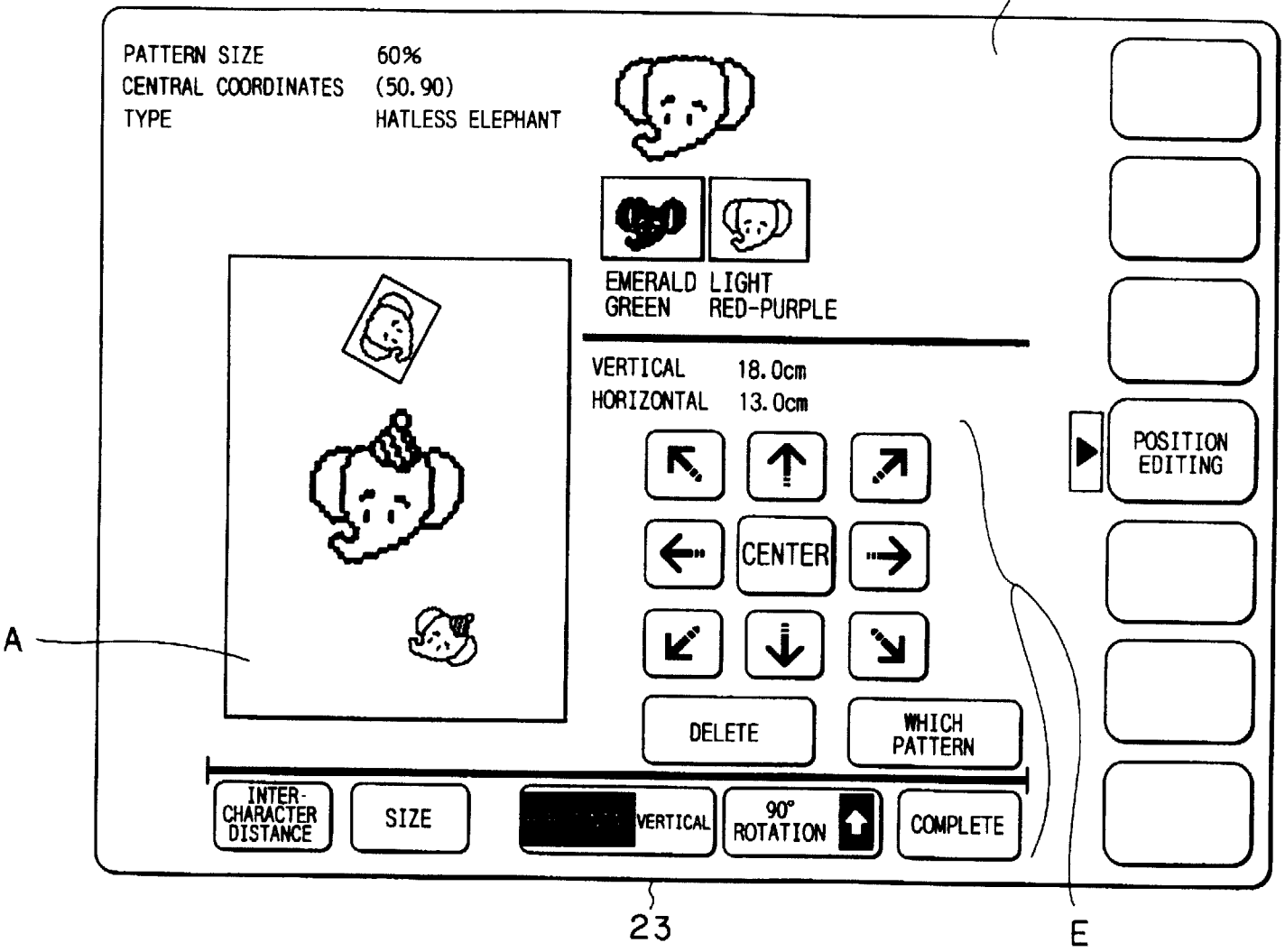
FIG. 20 is a schematic view showing the position editing screen when the user is changing orientation of the elephant picture pattern.

Although the three embroidery patterns used in the embodiment are quite dissimilar, when a user selects several patterns that are quite similar, it can be difficult to quickly determine which pattern is which. However, with the present invention, text describing the indicated pattern is displayed in order to provide the user with information which he or she can not easily discern by merely viewing the overall image. For example, as shown in FIG. 20, the magnification rate of the pattern, a short description "HATLESS ELEPHANT" for discerning the present embroidery pattern from the other patterns is displayed with text on other features of the subject pattern.

It should be noted that although the display data stored in the ROM 27 for the pattern selection screen is used to display the confirmation display region F of the position editing screen, the display data for the confirmation display region F could be prepared by calculations performed on the pattern data stored in the ROM 27. In this case, the size of the display can be freely set, for example, to a size larger than the display of the confirmation display region F.

The sewing pattern display device can be designed so that the user can manually indicate the embroidery pattern he or she wishes to edit. Alternatively, an automatic confirmation key can be provided. By pressing this key, the displayed embroidery patterns are automatically indicated and displayed on the confirmation display region F one after another. Further, a confirmation display can be automatically displayed after editing processes for the embroidery patterns is completed. Although in the present embodiment, information is displayed for embroidery pattern groups, that is, the "HAPPY" and the "HIMAWARI GUMI" character group pattern, information could be displayed for each unit of the different pattern groups, for example, "H", "A", "P", and the like could be displayed separately.

While the invention has been described in detail with reference to specific embodiments thereof, it would be apparent to those skilled in the art that carious changes and modifications may be made therein without departing from the spirit of the invention, the scope of which is defined by the attached claims.

For example, the present embodiment describes the present invention applied to a household sewing machine, but the present invention could also be applied to an industrially used sewing device. Further, the present invention could be applied to a processing device, such as, a personal computer for performing various processes on embroidery data independently from the sewing machine.

For example, the sewing machine could be connected to a mouse. The user could indicate the subject of editing processes in the layout region A by using an arrow responsive to the operations of the mouse. In this case, by indicating only a portion of a pattern group formed from a plurality of portion patterns sewn in a succession of sewing operations, then the entire pattern group (including the portion indicated) can be indicated together. For example, by using the mouse and the arrow to indicate the letter "A" of the character pattern group "HAPPY", the entire pattern group "HAPPY" would be indicated encompassed by the thin frame. Alternatively, the letter "A" only could be indicated encompassed by the thin frame so that the user could perform editing processes on the letter "A" only.

The present embodiment describes the case where the embroidery frame 18 moves the workpiece cloth with respect to the needle 14. However, the sewing machine could be configured so that the needle moves with respect to the workpiece cloth in order to sew embroidery patterns. Alternatively, both the needle and the workpiece cloth can be moved with respect to each other while sewing the embroidery pattern. In a further modification, the embroidery frame could be omitted. In this case, forward, rearward, leftward, and rightward movement with respect to the workpiece cloth is performed by the feed dog and horizontal movement of the needle.

Further, the memory device of the sewing machine is not limited to an internal ROM or an external ROM card. For example, only the internal ROM is sufficient. Alternatively, a variety of rewritable memory mediums, such as a RAM, an electromagnetic disk, or an optical disk, can serve effectively as a memory means. The display means is not limited to the LCD of the present embodiment, but could be a CRT display. Also, separately provided switches or a keyboard could serve effectively as a selection device and an indication device.

It can be assumed that a user will frequently edit the position of the embroidery pattern, that is, will frequently move the embroidery pattern, using the edit function of the above-described sewing machine. Therefore, by encompassing the subject of editing processes with the thin frame, the user will frequently reap the benefit of accurate editing ensured by the present invention. The present invention is particularly beneficial when applied to a sewing machine that automatically positions the selected embroidery pattern in a fixed position, such as in the center of the embroiderable region.

Next, the effects of the present invention will be described. Because the indicated portion pattern of the overall sewing pattern is displayed in a manner different from display of the other portions, the user can refer to the overall sewing pattern to quickly and accurately grasp which portion is being indicated. Also, because the sewing information relating to the indicated portion pattern is displayed, the user can refer to the display of the sewing information to gain a good understanding of the indicated portion.

Because the indicated portion pattern of the overall sewing pattern, which is configured from a plurality of portion patterns, is displayed separately from the other portions, and moreover, displayed in correspondence with how it will be sewn, and because the sewing information relating to the indicated portion pattern is displayed, therefore the user can reliably and accurately perform editing processes on the sewing patterns by referring to the display of the sewing information and to the display of the overall sewing pattern.

When the overall sewing pattern is displayed using a binary display and because the different colored regions of the indicated portion patterns are displayed in the portion information display means, the user can easily grasp what different colors are to be used to sew the overall sewing pattern.

Because the portion information display means displays the indicated portion pattern in a magnified or a fixed size, and therefore in more detail than does the overall display means, the user can more easily confirm accuracy and form of the separate portion patterns and the overall sewing pattern.

Because the portion information display displays information of the indicated portion pattern in accordance with individual sewing operations of a series of sewing operations, the user can easily confirm each separate sewing operation and the overall sewing pattern. Because the subject of movement operations is displayed in a manner to distinguish it from other portion patterns, the user can easily and accurately grasp which portion pattern is the subject of movement operations.

Because the sewing information relating to the indicated portion pattern is displayed, the user can easily and reliably confirm the indicated portion by referring to the display of the sewing information and of the overall sewing pattern.

What is claimed is:

1. A sewing pattern display device comprising:

an editing display means for simultaneously displaying a sewing pattern comprising a plurality of portion patterns to be sewn;

an indication means for indicating at least one portion pattern from the plurality of portion patterns; and a control means for controlling the editing display means to display the at least one portion pattern indicated by the indication means in a first display form and any remaining portion patterns not indicated by the indication means in a second display form different from the first display form.

2. A sewing pattern display device as claimed in claim 1, further comprising a portion information display means for displaying sewing information relating to the at least one portion pattern indicated by the indication means.

3. A sewing pattern display device as claimed in claim 2, wherein:

the editing display means displays the sewing pattern in a binary display; and the portion information display means separately displays different colored regions of the at least one portion pattern indicated by the indication means.

4. A sewing pattern display device as claimed in claim 2, wherein the portion information display means displays the at least one portion pattern in a fixed size.

5. A sewing pattern display device as claimed in claim 2, wherein:

the editing display means displays the at least one portion pattern in a first size; and the portion information display means displays the at least one portion pattern in a second size magnified larger than first size.

6. A sewing pattern display device as claimed in claim 1, wherein:

the sewing pattern display device is provided to a sewing device for sewing portion patterns using a sewing unit; and the editing display means displays the sewing pattern in correspondence with a sewing condition of the sewing device.

7. A sewing pattern display device as claimed in claim 6, wherein a sewing condition includes which portion pattern is presently being sewn.

8. A sewing pattern display device as claimed in claim 6, further comprising a portion information display means for displaying sewing information relating to the at least one portion pattern indicated by the indication means.

9. A sewing pattern display device as claimed in claim 8, wherein:

the editing display means displays portion patterns in a binary display; and the portion information display means separately displays different colored regions of the at least one portion pattern indicated by the indication means.

10. A sewing pattern display device as claimed in claim 6, wherein the indication means indicates the at least one portion pattern as a subject of portion pattern movement operations.

11. A sewing pattern display device as claimed in claim 1, wherein the at least one portion pattern includes a plurality of subportion patterns sewn in separate successive sewing operations.

12. A sewing pattern display device as claimed in claim 11, wherein the indication means is capable of separately indicating each one of the subportion patterns of the at least one portion pattern and the control means controls the editing display means to display any subportion patterns indicated by the indication means in the first display form.

13. A sewing pattern display device as claimed in claim 11, wherein the control means controls the editing display means to display the at least one portion pattern in the first display form when the indication means indicates any subportion pattern of the at least one portion pattern.

14. A sewing pattern display device as claimed in claim 13, wherein the indication means indicates the at least one portion pattern as a subject of portion pattern movement operations.

15. A sewing pattern display device as claimed in claim 13, further comprising a portion information display means for displaying sewing information relating to the at least one portion pattern indicated by the indication means.

16. A sewing pattern display device as claimed in claim 15, wherein:

the editing display means displays the sewing pattern in a binary display; and the portion information display means separately displays different colored regions of the at least one portion pattern indicated by the indication means.

17. A sewing pattern display device as claimed in claim 11, further comprising a portion information display means for displaying sewing information relating to the at least one portion pattern indicated by the indication means.

18. A sewing pattern display device as claimed in claim 17, wherein:

the editing display means displays the sewing pattern in a binary display; and the portion information display means separately displays different colored regions of the at least one portion pattern indicated by the indication means.

19. A sewing pattern display device as claimed in claim 1, wherein the control means controls the editing display means to display at least one of the first and second display forms in a blinking display form.

20. A sewing pattern display device as claimed in claim 1, wherein the editing display means displays the portion patterns simultaneously to form an overall sewing pattern.

21. A sewing pattern display device as claimed in claim 1, wherein portion patterns displayed in at least one of the first and second display forms are displayed encompassed by a frame.

22. A sewing pattern display device as claimed in claim 1, wherein portion patterns displayed in one of the first and second display forms are displayed darker than portion patterns displayed in another of the first and second display forms.

23. A sewing pattern display device as claimed in claim 1, wherein the indication means includes:

a portion pattern selection means for selecting portion patterns of the plurality of portion patterns; and a portion pattern indication means for indicating, as a subject of editing processes, the selected portion patterns selected by the portion pattern selection means, wherein the portion pattern indication means indicates the selected portion patterns in an order selected by the portion pattern selection means.

24. A sewing pattern display device as claimed in claim 23, further comprising a portion pattern memory for storing information on portion patterns selected by the portion pattern selection means, wherein portion patterns selected by the portion pattern selection means are stored in the portion pattern memory in the order selected by the portion selection means.

25. A sewing pattern display device comprising:

an editing display means for simultaneously displaying a sewing pattern comprising a plurality of portion patterns to be sewn;

an indication means for indicating at least one portion pattern from the plurality of portion patterns; and a portion information display means for displaying, while the editing display means simultaneously displays the sewing pattern, sewing information relating to the at least one portion pattern indicated by the indication means.

* * * * *